US008236473B2

(12) United States Patent
Kawase et al.

(10) Patent No.: US 8,236,473 B2
(45) Date of Patent: Aug. 7, 2012

(54) METHOD FOR MANUFACTURING RESIN-LAYER COATED TONER, RESIN-LAYER COATED TONER, DEVELOPER, DEVELOPING APPARATUS AND IMAGE FORMING APPARATUS

(75) Inventors: Yoshitaka Kawase, Osaka (JP); Takashi Hara, Osaka (JP); Yoshiaki Akazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 442 days.

(21) Appl. No.: 12/605,686

(22) Filed: Oct. 26, 2009

(65) Prior Publication Data

US 2010/0104324 A1 Apr. 29, 2010

(30) Foreign Application Priority Data

Oct. 28, 2008 (JP) ..... P2008-277513

(51) Int. Cl.
*G03G 9/08* (2006.01)

(52) U.S. Cl. ..... 430/137.1; 430/137.11

(58) Field of Classification Search ..... 430/137.1, 430/137.11

See application file for complete search history.

(56) References Cited

U.S. PATENT DOCUMENTS 4,915,987 A 4/1990 Nara et al.
2005/0282078 A1 12/2005 Kataoka et al.
2008/0166156 A1 7/2008 Kawase

FOREIGN PATENT DOCUMENTS

| | | | |
|---|---|---|---|
| CN | 1710492 A | | 12/2005 |
| JP | 64-042660 | | 2/1989 |
| JP | 01306859 | * | 12/1989 |
| JP | 5-10971 | | 2/1993 |
| JP | 5-10971 | | 12/1993 |
| JP | 2004-082005 | | 3/2004 |
| JP | 2004294468 | * | 10/2004 |
| JP | 2008-191639 A | | 8/2008 |

* cited by examiner

*Primary Examiner* — Hoa V Le
(74) *Attorney, Agent, or Firm* — Nixon & Vanderhye, P.C.

(57) ABSTRACT

A method for manufacturing a resin-layer coated toner is provided. The method for manufacturing the resin-layer coated toner uses a rotary stirring apparatus including a circulating section, a temperature regulation section, a spraying section and an exhausting section, sprays a liquid substance to particles of toner materials and particles of coating materials in a fluidized state to plasticize such particles from a spraying section by carrier gas and gasifies the liquid, circulates the carrier gas in the powder passage and continuously exhausts the carrier gas including the gasified substance through the exhausting section to the outside of the powder passage, and pressure $P_1$ in the powder passage and pressure $P_0$ outside the powder passage satisfy the following formula (1):

$$0\ \text{atm} < (\text{Pressure } P_1 \text{ in the powder passage} - \text{Pressure } P_0 \text{ outside the powder passage}) \leqq 0.3\ \text{atm} \quad (1).$$

3 Claims, 6 Drawing Sheets

METHOD FOR MANUFACTURING RESIN-LAYER COATED TONER, RESIN-LAYER COATED TONER, DEVELOPER, DEVELOPING APPARATUS AND IMAGE FORMING APPARATUS

CROSS-REFERENCE TO RELATED APPLICATION

This application claims priority to Japanese Patent Application No. 2008-277513, which was filed on Oct. 28, 2008, the contents of which are incorporated herein by reference in its entirety.

BACKGROUND OF THE INVENTION

1. Field of the Invention

The present invention relates to a method for manufacturing a resin-layer coated toner and a resin-layer coated toner obtained by the same, a developer including the resin-layer coated toner, as well as a developing apparatus using the developer and an image forming apparatus.

2. Description of the Related Art

Conventionally, a surface modification treatment for coating the surface of powder particles with a coating material has been performed in order to improve characteristics of the powder particles such as toner particles.

As a method for the surface modification treatment of the powder particles such as toner particles, a method is known that a mechanical stirring force is applied to the powder particles by a rotary stirring section such as a screw, a blade, or a rotor to fluidize the powder particles in a powder flowing passage and a coating material is ejected from a spray nozzle to the powder particles in a fluidized state.

For example, Japanese Examined Patent Publication JP-B2 5-10971 (1993) discloses a surface modification method of solid particles in which a rotary stirring section is rotated at peripheral speed of 5 to 160 m/sec to fluidize powder particles and a liquid is sprayed from a spray nozzle to the powder particles in a fluidized state to adhere fine solid particles contained in the liquid to surface of the powder particles or to form a film of a coating material contained in the liquid on the surface of the power particles. According to the surface modification method disclosed in JP-B2 5-10971, adhesiveness between the coating material and the powder particles is able to be improved and time required for the surface modification treatment is able to be shortened.

However, the method disclosed in Japanese Examined Patent Publication JP-B2 5-10971 (1993) causes following problems. When the rotary stirring section fluidizes powder particles by applying mechanical stirring forces and a liquid substance containing coating materials is ejected to the powder particles in a fluidized state from a spray nozzle, the liquid substance is gasified inside a powder passage depending on the kinds of the liquid substance. Accordingly, the gasified substance needs to be exhausted to the outside of the powder passage, and without exhausting the gasified substance to the outside, a drying speed of the liquid substance is reduced, thus the powder particles in which an undried liquid substance is remained adhere to other powder particles to generate an aggregate of the powder particles, which causes a problem of the lowered yield of the coating particles.

Furthermore, when the powder particles having undried liquid substance left are present, the powder particles are likely to adhere to an inner wall of the apparatus and there is a possibility that, with the adhered powder particles as a core, other powder particles and coating materials aggregate and grow. When the powder particles and the coating materials aggregate and grow on the inner wall of the apparatus, there causes a problem that the passage for the powder particles to flow becomes narrow enough to prevent isolated flowing of the powder particles, as well as a problem of the lowered yield of the coating particles. It is impossible to solve such problems without stably exhausting the gasified substance to the outside of the powder passage.

SUMMARY OF THE INVENTION

An object of the invention is to provide a method for manufacturing a resin-layer coated toner comprising a step of spraying to particles of toner materials and particles of coating materials in a fluidized state a liquid substance to plasticize such particles from a spraying section by carrier gas and gasifying the liquid substance, wherein the resin-layer coated toner excellent in film quality is obtained in high yield by stably exhausting the gasified substance to the outside of a powder passage while the fluidized state of the particles of toner materials and the particles of coating materials is maintained, a resin-layer coated toner manufactured by the method for manufacturing thereof, a developer including the resin-layer coated toner, as well as a developing apparatus using the developer and an image forming apparatus.

The invention provides a method for manufacturing a resin-layer coated toner using a rotary stirring apparatus that comprises a circulating section including a rotary stirring section having a rotary disc around which rotary blades are installed and a rotary shaft, and a powder passage having a rotary stirring chamber and a circulation tube, the circulating section repeatedly circulating toner base particles and fire resin particles by the rotary stirring section inside the powder passage to return to the rotary stirring chamber; a temperature regulation section provided at least on a part of the powder passage for adjusting a temperature in the powder passage and the rotary stirring section to a predetermined temperature; a spraying section that includes a two-fluid nozzle for spraying to toner base particles and fine resin particles in a fluidized state a liquid substance to plasticize such particles by carrier gas; and an exhausting section for exhausting carrier gas including the gasified substance to the outside of the powder passage, the method comprising:

circulating the carrier gas in the powder passage; and continuously exhausting the carrier gas including the gasified substance to the outside of the power passage through the exhausting section, pressure $P_1$ in the powder passage and pressure $P_0$ outside the powder passage satisfying the following formula (1):

$$0\ \text{atm} < (\text{Pressure } P_1 \text{ in the powder passage} - \text{Pressure } P_0 \text{ outside the powder passage}) \leqq 0.3\ \text{atm} \quad (1).$$

According to the invention, the method for manufacturing a resin-layer coated toner uses a rotary stirring apparatus including a circulating section for repeatedly circulating toner base particles and fine resin particles in a powder passage a rotary stirring section; a temperature regulation section for adjusting a temperature in the powder passage and the rotary stirring section; a spraying section including a two-fluid nozzle for spraying a liquid substance to plasticize toner base particles and fine resin particles by carrier gas; and an exhausting section for exhausting carrier gas including the gasified substance to the outside of the power passage. In the method for manufacturing a resin-layer coated toner, the carrier gas in the powder passage is circulated and the carrier gas including the gasified substance is continuously exhausted to the outside of the powder passage through the exhausting section, and pressure $P_1$ in the powder passage and pressure $P_0$ outside the powder passage satisfy the above-described formula (1).

When the liquid substance to plasticize the toner base particles and the fine resin particles is sprayed by carrier gas from the spraying section including the two-fluid nozzle, the liquid substance plasticizes the toner base particles and the fine resin particles and is gasified in the apparatus. By stirring the toner base particles and the fine resin particles plasticized by the liquid substance in the apparatus, the fine resin particles form a resin layer on the surface of the toner base particles so that a resin-layer coated toner is obtained. In such a method for manufacturing the resin-layer coated toner, the carrier gas is introduced from the spraying section and is fluidized by the circulating section to keep the pressure in the apparatus high and the carrier gas including the gasified substance (hereinafter, also referred to as "carrier gas including gasified substance") is exhausted to the outside of the powder passage through the exhausting section, when pressure $P_1$ in the powder passage and pressure $P_0$ outside the powder passage satisfy the above-described formula (1), it is thus possible to stably exhaust the carrier gas including gasified substance, allowing the fluidized state of the toner base particles and the fine resin particles to be maintained. Furthermore, it is possible to suppress generation of coarse particles due to a reduced drying speed of the liquid, and to prevent the toner base particles and the fine resin particles from adhering to an inner wall of the powder passage to aggregate and grow. Accordingly, it is possible to obtain the resin-layer coated toner having a small coarse-particle content and excellent film quality with high yield.

When a difference between pressure $P_1$ in the powder passage and pressure $P_0$ outside the powder passage is 0 atm or less, it is impossible to stably exhaust the carrier gas including gasified substance to the outside of the powder passage, and the fluidized state of the toner base particles and the fine resin particles becomes unstable. When the difference between the pressure $P_1$ in the powder passage and the pressure $P_0$ outside the powder passage exceeds 0.3 atm and the pressure in the powder passage becomes too high, the liquid substance to plasticize the toner base particles and the fine resin particles becomes difficult to be gasified, and even when gasified, becomes difficult to be exhausted from the inside of the powder passage, thus the gasified substance is absorbed inside the toner base particles and the fine resin particles to generate an aggregate and increase the ratio of a coarse-powder content is, as a result, a coating uniformity and a yield are lowered.

Further, in the invention, it is preferable that the pressure $P_0$ outside the powder passage is normal pressure, and the pressure $P_1$ in the powder passage and the pressure $P_0$ outside the powder passage satisfy the following formula (2):

$$0.03\ \text{atm} \leqq (\text{Pressure } P_1 \text{ in the powder passage} - \text{Pressure } P_0 \text{ outside the powder passage}) \leqq 0.25\ \text{atm} \quad (2).$$

According to the invention, the pressure $P_0$ outside the powder passage is normal pressure, and the pressure $P_1$ in the powder passage and the pressure $P_0$ outside the powder passage satisfy the formula (2) above. Thereby, it is possible to make a state of spraying the liquid substance and a state of exhausting the carrier gas including gasified substance to the outside of the powder passage more excellent. Accordingly, it is possible to obtain the resin-layer coated toner having a small coarse-particle content and excellent film quality in even higher yield.

Further, in the invention, it is preferable that the liquid substance includes at least an alcohol.

According to the invention, the liquid substance contains at least an alcohol. Thereby, the viscosity of the liquid substance is lowered and it is possible, without coarsening a sprayed droplet diameter of the liquid substance sprayed by the spraying section, to conduct fine spraying and spray the liquid substance having a uniform droplet diameter. Furthermore, when the toner base particles and the fine resin particles collide with the droplets, it is possible to further promote fining of the droplet diameter. Thereby, it is possible to obtain a resin-layer coated toner excellent in uniformity of a coating amount of the fine resin particles serving as a coating material. Furthermore, an alcohol has a vapor pressure large enough to be easily dried and removed in the powder passage. Accordingly, it is possible to obtain the resin-layer coated toner having a small coarse-particle content and excellent film quality with even higher yield.

Further, the invention provides a resin-layer coated toner that is manufactured by the method for manufacturing the resin-layer coated toner mentioned above.

According to the invention, a resin-layer coated toner is manufactured by the method for manufacturing the resin-layer coated toner mentioned above. Thereby, in the resin-layer coated toner of the invention, an amount of the fine resin particles serving as the coating material to coat the toner base particles is uniform and toner properties such as chargeability between individual particles of the resin-layer coated toner is uniform. Furthermore, the resin-layer coated toner has an effect to protect a contained component by the resin layer on the surface of the toner to be excellent in durability. When an image is formed using such a resin-layer coated toner, it is possible to stably form an image that is highly-defined without density unevenness and excellent in image quality.

Further, the invention provides a developer including the resin-layer coated toner mentioned above.

According to the invention, a developer contains the resin-layer coated toner mentioned above. Thereby, it is possible to obtain a developer that has uniform tones properties such as chargeability between individual particles of the resin-layer coated toner and is capable of maintaining an excellent developing property.

Further, in the invention, it is preferable that the developer further comprises a carrier and constitutes a two-component developer.

According to the invention, the developer is a two-component developer composed of the resin-layer coated toner of the invention and a carrier. The resin-layer coated toner of the invention has uniform toner properties such as chargeability between individual particles of the toner, which makes it possible to constitute a two-component developer capable of stably forming an image that is highly-defined without density unevenness and excellent in image quality.

Further, the invention provides a developing device that develops a latent image formed on an image bearing member to form a toner image using the developer mentioned above.

According to the invention, a developing apparatus uses the developer of the invention to form a toner image. Thereby, it is possible to stably form a highly-defined excellent toner image without density unevenness on an image carrier.

Further, the invention provides an image forming apparatus, comprising:

an image bearing member on which a latent image is to be formed;

a latent image forming section for forming the latent image on the image bearing member; and the developing device mentioned above.

According to the invention, the image forming apparatus includes a developing apparatus of the invention. By forming an image with such an image forming apparatus, it is possible to stably form an image that is highly-defined without density unevenness and excellent in image quality.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
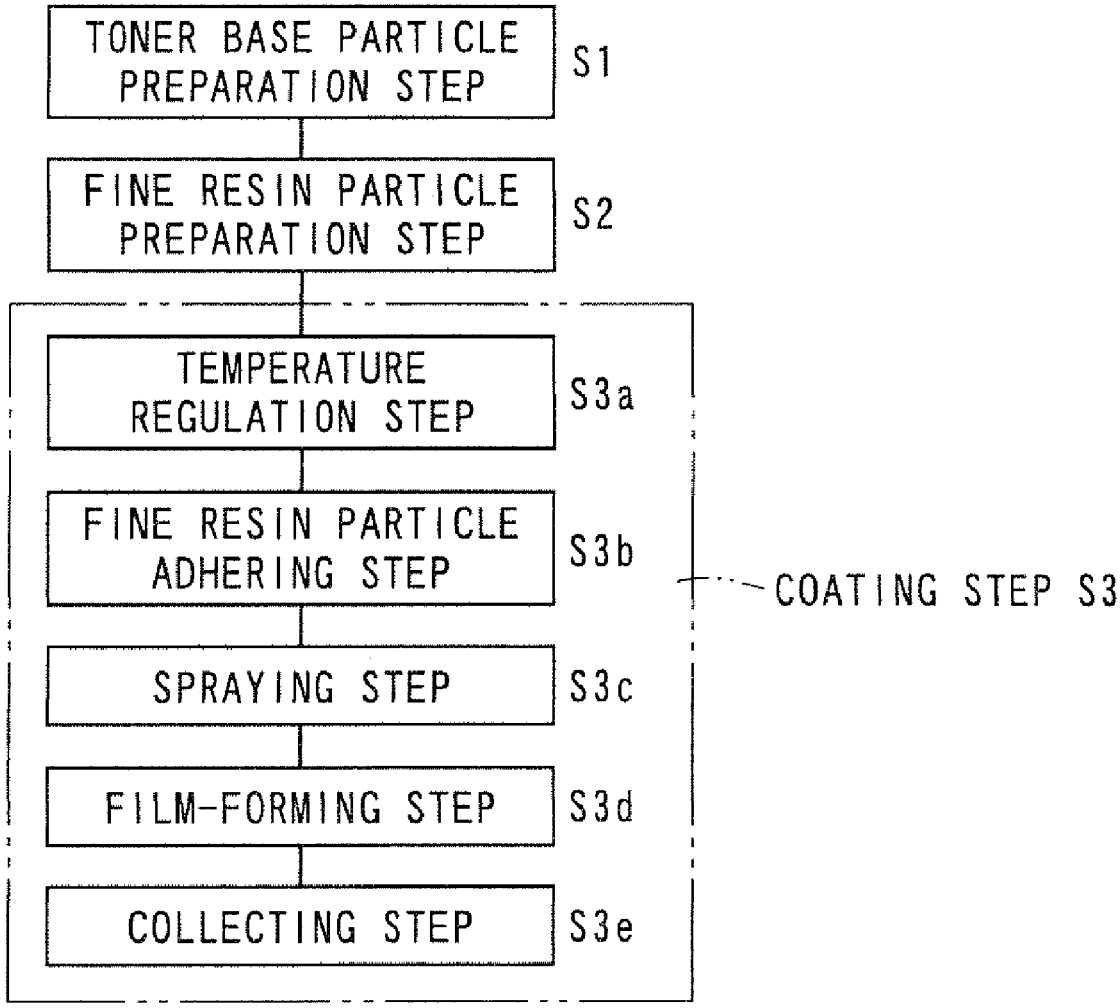
FIG. 1 is a flowchart of an example of a procedure for a method for manufacturing a toner of a first embodiment of the invention.

Now referring to the drawings, preferred embodiments of the invention are described below.

1. Method for Manufacturing a Toner

FIG. 1 is a flowchart showing an example of procedures of the method for manufacturing a resin-layer coated toner of a first embodiment of the invention. As shown in FIG. 1, the method for manufacturing the resin-layer coated toner (hereinafter, also referred to simply as "toner") of the embodiment includes a toner base particle preparation step S1 for preparing toner base particles, a fine resin particle preparation step S2 for preparing fine resin particles, and a coating step S3 for film-forming by coating the toner base particles with the fine resin particles.

(1) Toner Base Particle Preparation Step

At the toner base particle preparation step of step S1, toner base particles to be coated with a resin layer are prepared. The toner base particles are particles containing a binder resin and a colorant and are able to be obtained with a known method without particular limitation to a preparation method thereof. Examples of the method for preparing toner base particles include dry methods such as pulverization methods, and wet methods such as suspension polymerization methods, emulsion aggregation methods, dispersion polymerization methods, dissolution suspension methods and melting emulsion methods. The method for preparing toner base particles using a pulverization method will be described below.

(Method for Preparing Toner Base Particles by a Pulverization Method)

In a method for preparing toner base particles using a pulverization method, a toner composition containing a binder resin, a colorant and other additives is dry-mixed by a mixer, and thereafter melt-kneaded by a kneading machine. The kneaded material obtained by melt-kneading is cooled and solidified, and then the solidified material is pulverized by a pulverizing machine. Subsequently, the toner base particles are optionally obtained by conducting adjustment of a particle size such as classification.

Usable mixers include heretofore known mixers including, for example, Henschel-type mixing devices such as HENSCHELMIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., RCM-65/87 and PCM-30, both of which are trade names and manufactured by Ikegai, Ltd., and open roll-type kneading machines such as KNEADEX (trade name) manufactured by Mitsui Mining Co., Ltd. Among them, the open roll-type kneading machines are preferable.

Examples of the pulverizing machine include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner base particles by classification with a centrifugal force or classification with a wind force is usable and an example thereof includes a revolving type wind-force classifying machine (rotary type wind-force classifying machine).

(Raw Materials of Toner Base Particles)

As described above, the toner base particles contain the binder resin and the colorant. The binder resin is not particularly limited and any known binder resin used for a black toner or a color toner is usable, and examples thereof include a styrene resin such as a polystyrene and a styrene-acrylic acid ester copolymer resin, an acrylic resin such as a polymethylmethacrylate, a polyolefin resin such as a polyethylene, a polyester, a polyurethane, and an epoxy resin. Further, a resin obtained by polymerization reaction induced by mixing a monomer mixture material and a release agent may be used. The binder resin may be used each alone, or two or more of them may be used in combination.

Among the binder resins, polyester is preferable as binder resin for color toner owing to its excellent transparency as well as good powder flowability, low-temperature fixing property, and secondary color reproducibility. For polyester, heretofore known substances may be used including a polycondensation of polybasic acid and polyvalent alcohol.

For polybasic acid, substances known as monomers for polyester can be used including, for example: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and methyl-esterified compounds of these polybasic acids. The polybasic acids may be used each alone, or two or more of them may be used in combination.

For polyvalent alcohol, substances known as monomers for polyester can also be used including, for example: aliphatic polyvalent alcohols such as ethylene glycol, propylene glycol, butenediol, hexane diol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more of them may be used in combination.

The polybasic acid and the polyvalent alcohol can undergo polycondensation reaction in an ordinary manner, that is, for example, the polybasic acid and the polyvalent alcohol are brought into contact with each other in the presence or absence of the organic solvent and in the presence of the polycondensation catalyst. The polycondensation reaction ends when an acid number, a softening temperature, etc. of the polyester to be produced reach predetermined values. The polyester is thus obtained. When the methyl-esterified compound of the polybasic acid is used as part of the polybasic acid, demethanol polycondensation reaction is caused. In the polycondensation reaction, a compounding ratio, a reaction rate, etc. of the polybasic acid and the polyvalent alcohol are appropriately modified, thereby being capable of, for example, adjusting a content of a carboxyl end group in the polyester and thus allowing for denaturation of the polyester. The denatured polyester can be obtained also by simply introducing a carboxyl group to a main chain of the polyester with use of trimellitic anhydride as polybasic acid. Note that polyester self-dispersible in water may also be used which polyester has a main chain or side chain bonded to a hydrophilic radical such as a carboxyl group or a sulfonate group. Further, polyester may be grafted with acrylic resin.

It is preferred that the binder resin have a glass transition temperature of 30° C. or higher and 80° C. or lower. The binder resin having a glass transition temperature lower than 30° C. easily causes the blocking that the toner thermally aggregates inside the image forming apparatus, which may decrease preservation stability. The binder resin having a glass transition, temperature higher than 80° C. lowers the fixing property of the toner onto a recording medium, which may cause a fixing failure.

As the colorant, it is possible to use an organic dye, an organic pigment, an inorganic dye, an inorganic pigment or the like which is customarily used in the electrophotographic field.

Black colorant includes, for example, carbon black, copper oxide, manganese dioxide, aniline black, activated carbon, non-magnetic ferrite, magnetic ferrite, and magnetite.

Yellow colorant includes, for example, yellow lead, zinc yellow, cadmium yellow, yellow iron oxide, mineral fast yellow, nickel titanium yellow, navel yellow, naphthol yellow S, hanza yellow G, hanza yellow 10G, benzidine yellow C, benzidine yellow CR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, and C.I. pigment yellow 185.

Orange colorant includes, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Red colorant includes, for example, red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Purple colorant includes, for example, manganese purple, fast violet B, and methyl violet lake.

Blue colorant includes, for example, Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Green colorant includes, for example, chromium green, chromium oxide, pigment green B, malachite green lake, final yellow green G, and C.I. pigment green 7.

White colorant includes, for example, those compounds such as zinc white, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 5 parts by weight to 20 parts by weight, and more preferably 5 parts by weight to 10 parts by weight based on 100 parts by weight of the binder resin.

The colorant may be used as a masterbatch to be dispersed uniformly in the binder resin. Further, two or more kinds of the colorants may be formed into a composite particle. The composite particle is capable of being manufactured, for example, by adding an appropriate amount of water, lower alcohol and the like to two or more kinds of colorants and granulating the mixture by a general granulating machine such as a high-speed mill, followed by drying. The masterbatch and the composite particle are mixed into the toner composition at the time of dry-mixing.

The toner base particles may contain a charge control agent in addition to the binder resin and the colorant. For the charge control agent, charge control agents commonly used in this field for controlling a positive charge and a negative charge are usable.

Examples of the charge control agent for controlling a positive charge include a basic dye, a quaternary ammonium salt, a quaternary phosphonium salt, an aminopyrine, a pyrimidine compound, a polynuclear polyamino compound, an aminosilane, a nigrosine dye, a derivative thereof, a triphenylmethane derivative, a guanidine salt and an amidin salt.

Examples of the charge control agent for controlling a negative charge include an oil-soluble dye such as an oil black and a spirone black, a metal-containing azo compound, an azo complex dye, a naphthene acid metal salt, a metal complex or metal salt (the metal is a chrome, a zinc, a zirconium or the like) of a salicylic acid or of a derivative thereof, a boron compound, a fatty acid soap, a long-chain alkylcarboxylic acid salt and a resin acid soap. The charge control agents may be used each alone, or optionally two or more of them may be used in combination. Although the amount of the charge control agent to be used is not particularly limited and can be properly selected from a wide range, 0.5 parts by weight or more and 3 parts by weight or less is preferably used relative to 100 parts by weight of the binder resin.

Further, the toner base particles may contain a release agent in addition to the binder resin and the colorant. As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

The toner base particles obtained at the toner base particle preparation step S1 preferably have a volume average particle size of 4 μm or more and 8 μm or less. In a case where the volume average particle size of the toner base particles is 4 μm or more and 8 μm or less, it is possible to stably form a high-definition image for a long time. Moreover, by reducing the particle size to this range, a high image density is obtained even with a small amount of adhesion, which generates an effect capable of reducing an amount of toner consumption. In a case where the volume average particle size of the toner base particles is less than 4 μm, the particle size of the toner base particles becomes too small and high charging and low fluidity are likely to occur. When the high charging and the low fluidity occur, a toner is unable to be stably supplied to a photoreceptor and a background fog and image density decrease are likely to occur. In a case where the volume average particle size of the toner base particles exceeds 8 μm, the particle size of the toner base particles becomes large and the layer thickness of a formed image is increased so that an image with remarkable granularity is generated and the high-definition image is not obtainable, which is undesirable. In addition, as the particle size of the toner base particles is increased, a specific surface area is reduced, resulting in decrease in a charge amount of the toner. When the charge amount of the toner is reduced, the toner is not stably supplied to the photoreceptor and pollution inside the apparatus due to toner scattering is likely to occur.

(2) Fine Resin Particle Preparation Step

At the fine resin particle preparation step of step S2, dried fine resin particles are prepared. Any method may be used for the drying method and it is possible to obtain the dried fine resin particles by using methods such as drying of a hot air receiving type, drying of heat transfer by heat conduction type, far infrared radiation drying, and microwave drying. The fine resin particles are used as a material for coating the toner base particles at the subsequent coating step S3. By using the fine resin particles as the film-forming material on the surface of the toner base particles, for example, it is possible to prevent generation of aggregation due to melting of low-melting point components such as a release agent contained in the toner base particles during storage.

The fine resin particle is, for example, obtainable by an emulsion polymerization reaction of a monomer component of the resin, or by fine granulation of the resin emulsified and dispersed by a homogenizer or the like.

For the resin used for raw materials of the fine resin particles, a resin used for materials of a toner is usable and examples thereof include a polyester, an acrylic resin, a styrene resin, and a styrene-acrylic copolymer. Among the resins exemplified above, the fine resin particles preferably contain an acrylic resin and a styrene-acrylic copolymer. The acrylic resin and the styrene acrylic copolymer have many advantages such that the strength is high with light weight, transparency is high, the price is low, and materials having a uniform particle size are easily obtained.

Although the resin used for raw materials of the fine resin particles may be the same kind of resin as the binder resin contained in the toner base particles or may be a different kind of resin, the different kind of resin is preferably used in view of performing the surface modification of the toner. When the different kind of resin is used as the resin used for the raw materials of the fine resin particles, a softening temperature of the resin used for the raw materials of the fine resin particles is preferably higher than a softening temperature of the binder resin contained in the toner base particles. This makes it possible to prevent toners manufactured with the manufacturing method of this embodiment from being fused each other during storage and to improve storage stability. Further, the softening temperature of the resin used for the raw materials of the fine resin particles depends on an image forming apparatus in which the toner is used, but is preferably 80° C. or more and 140° C. or less. By using the resin in such a temperature range, it is possible to obtain the toner having both the storage stability and the fixing performance.

The fine resin particles need to have a sufficiently smaller volume average particle size than an average particle size of the toner base particles, which is preferably 0.05 μm or more and 1 μm or less. The volume average particle size of the fine resin particles is more preferably 0.1 μm or more and 0.5 μm or less. With the volume average particle size of the fine resin particles being 0.05 μm or more and 1 μm or less, plasticization and deformation are easily performed to form a homogeneous coating layer on the surface of the toner. Thereby, storage stability and durability of the toner manufactured by the method for manufacturing of the embodiment are enhanced.

(3) Coating Step

<Toner Manufacturing Apparatus>

Figure 2:
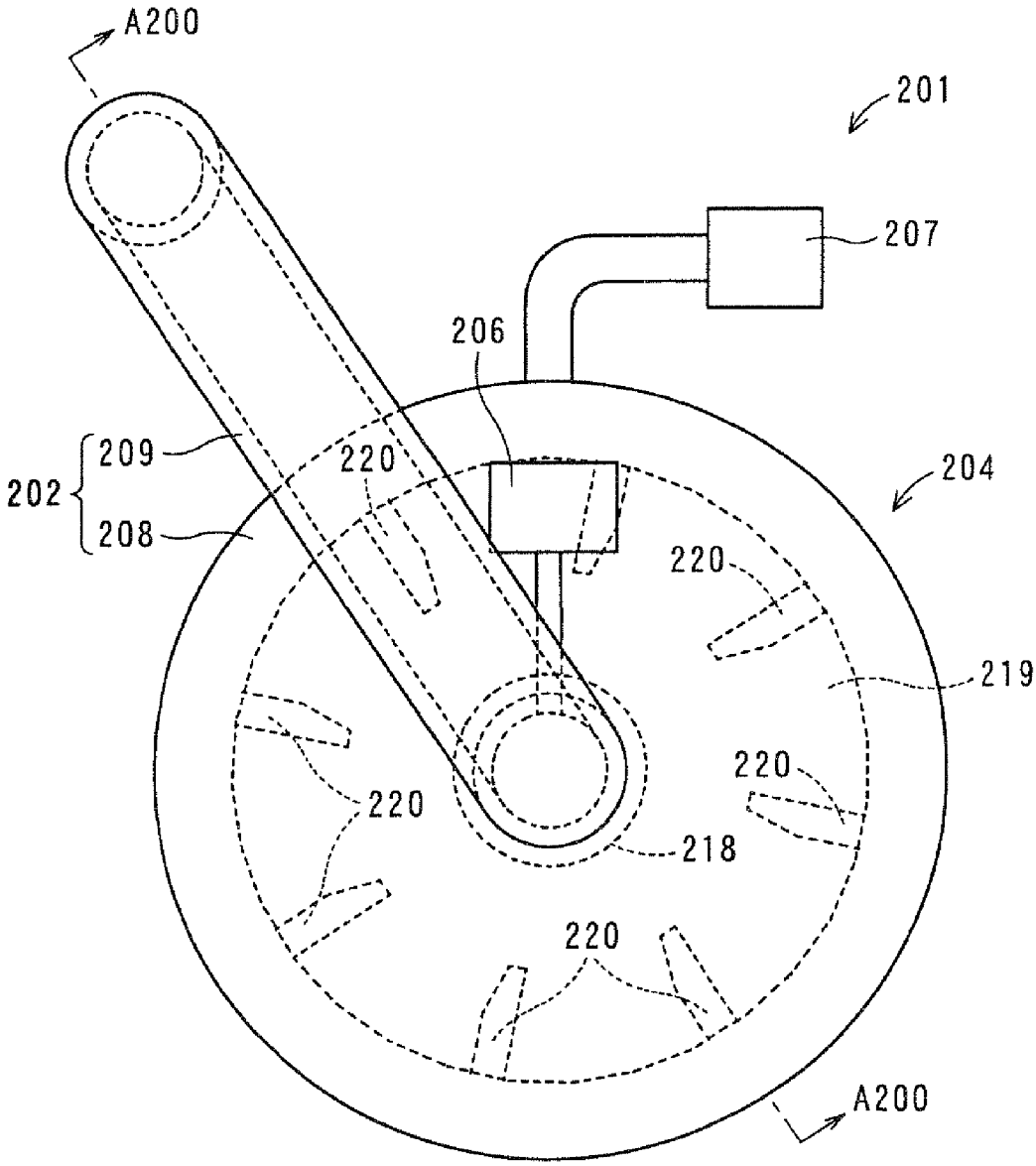
FIG. 2 is a front view of a configuration of a toner manufacturing apparatus used for the method for manufacturing a toner according to the first embodiment of the invention.
Figure 3:
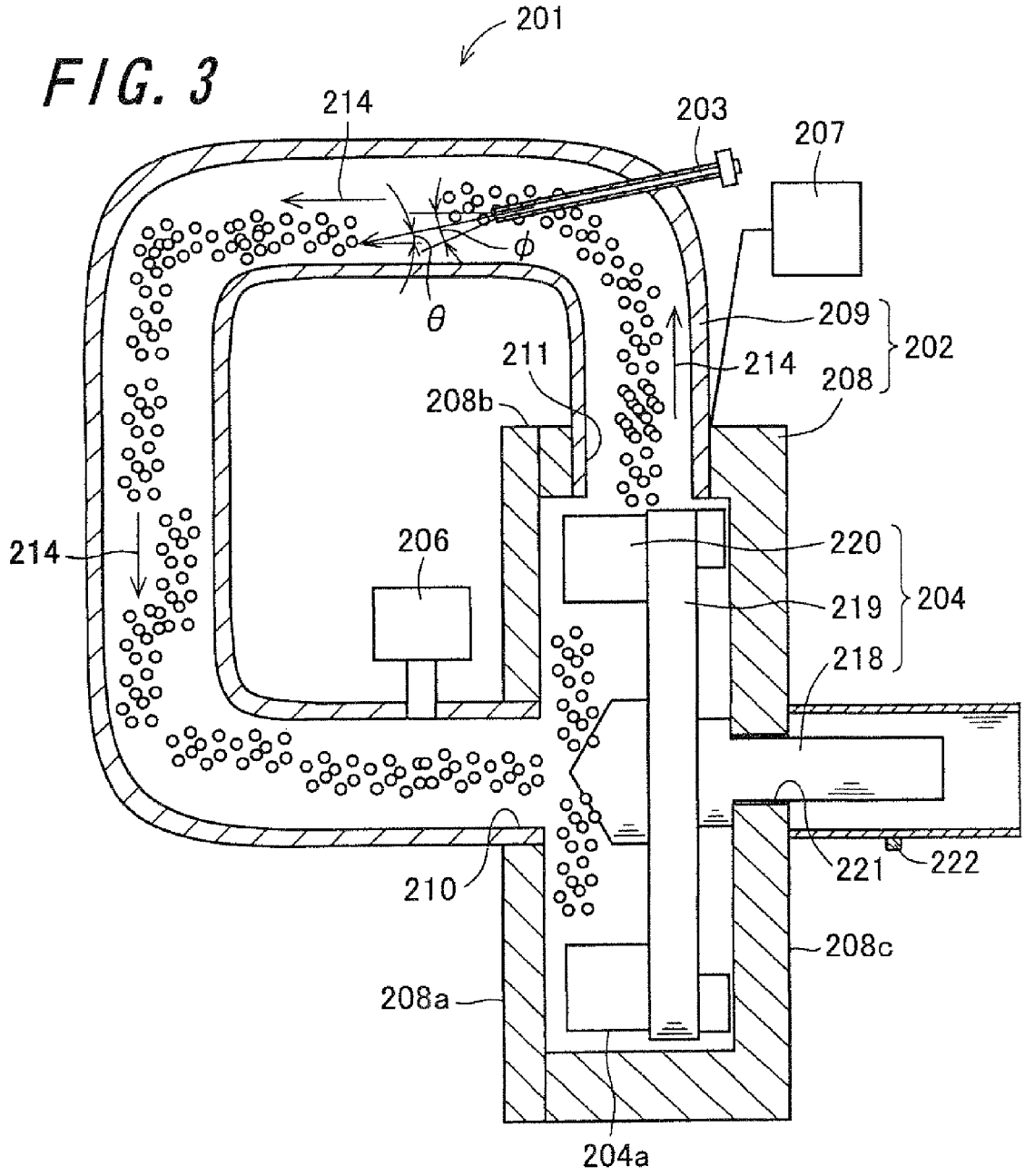
FIG. 3 is a schematic sectional view of the toner manufacturing apparatus shown in FIG. 2 taken along the cross-sectional line A200-A200.

FIG. 2 is a front view showing a configuration of a toner manufacturing apparatus 201 used for the method for manufacturing the toner of the first embodiment of the invention. FIG. 3 is a schematic cross-sectional view of the toner manufacturing apparatus 201 shown in FIG. 2, which is taken along the cross-sectional line A200-A200. At the coating step of step S3, for example, the toner manufacturing apparatus 201 shown in FIG. 2 is used to adhere the fine resin particles prepared at the fine resin particle preparation step of step S2 to the toner base particles prepared at the toner base particle preparation step of step S1, and a resin film is formed on the toner base particles by a multiplier effect of impact forces caused by circulation and stirring inside the apparatus. The toner manufacturing apparatus 201 serving as a rotary stirring apparatus includes a powder passage 202, a spraying section 203, a rotary stirring section 204, a temperature regulation jacket (not shown), a powder inputting section 206, and a powder collecting section 207. The rotary stirring section 204 and the powder passage 202 constitute a circulating section.

(Powder Passage)

The powder passage 202 is comprised of a stirring section 208 and a powder flowing section 209. The stirring section 208 is a cylindrical container-like member having an internal space. Opening sections 210 and 211 are formed in the stirring section 208 which is a rotary stirring chamber. The opening section 210 is formed at an approximate center part of a surface 208*a* in one side of the axial direction of the stirring section 208 so as to penetrate a side wall including the surface 208*a* of the stirring section 208 in the thickness direction. Moreover, the opening section 211 is formed at a side surface 208*b* perpendicular to the surface 208*a* in one side of the axial direction of the stirring section 208 so as to penetrate a side wall including the side surface 208*b* of the stirring section 200 in the thickness direction. The powder flowing section 209 which is a circulation tube has one end connected to the opening section 210 and the other end connected to the opening section 211. Whereby, the internal space of the stirring section 208 and the internal space of the powder flowing section 209 are communicated to form the powder passage 202. The toner base particles, the fine resin particles and gas flow through the powder passage 202. The powder passage 202 is provided so that the powder flowing direction which is a direction in which the toner base particles and the fine resin particles flow is constant.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted in a through-hole 221 formed at the surface 208*c* in the other side of the axial direction of the stirring section 208 to penetrate the side wall including the surface 208*c* in the thickness direction, and that is rotated around the axis by a motor (not shown). The rotary disc 219 is a discotic member having the axis supported by the rotary shaft member 218 so as to match the axis of the rotary shaft member 218 and rotating with rotation of the rotary shaft member 218. The plurality of stirring blades 220 are supported by the peripheral edge of the rotary disc 219 and are rotated with rotation of the rotary disc 219.

The rotary shaft member 218 is rotatable when a peripheral speed is 50 m/sec or more on an outermost peripheral. The outermost peripheral is a part of the rotary stirring section 204 which has the longest distance to the rotary shaft member 218 in the direction perpendicular to the rotary shaft member 218. From a through-hole 221 communicating with inside of a powder passage 202 and outside of the powder passage 202, carrier gas supplied from a spraying section described below to the inside of the powder passage 202, and the like, are exhausted to the outside of the powder passage.

(Spraying Section)

The spraying section 203 is provided, in a powder flowing section 209 of the powder passage 202, at the powder flowing section on a side closest to an opening section 211 in the flowing direction of the toner base particles and the fine resin particles. The spraying section 203 includes a liquid reservoir for reserving a liquid substance, a carrier gas supplying section for supplying the carrier gas, and a two-fluid nozzle for mixing the liquid substance and the carrier gas, ejecting the obtained mixture to the toner base particles and the fine resin particles present in the powder passage 202, and spraying droplets of the liquid substance to the toner base particles and the fine resin particles. For the carrier gas, compressed air and the like are usable. The two-fluid nozzle has a structure that a liquid tube and an air tube are partially connected so as not to shift the center of the liquid tube and the air tube. Spraying the liquid substance at a constant speed by the spraying section 203 keeps the concentration in the powder passage constant and by a multiplier effect of the circulating section and the temperature regulation section, the fine resin particles are plasticized to enable the toner having a homogeneous film quality and particle size to be obtained. Furthermore, in an ejecting zone of the liquid and the compressed air of the two-fluid nozzle, a projected-shape adhesion preventing member for preventing adhesion of the toner base particles and the fine resin particles is disposed, so that the effect is enhanced to enable the high yield in manufacturing.

(Temperature Regulation Jacket)

The temperature regulation jacket (not shown) which is a temperature regulation section is provided at least on a part of the outside of the powder passage 202 and adjusts temperatures in the powder passage 202 and of the rotary stirring section 204 to a predetermined temperature by passing a cooling medium or a heating medium through the internal space of the jacket. In this embodiment, the temperature regulation jacket is preferably provided over the entire outside of the powder passage 202. Whereby, the fine resin particles are adhered to the toner base particles to form a film smoothly and an adhesive force to the inner wall of the powder passage is further reduced, thus making it possible to further suppress adhesion of the toner base particles and the fine resin particles to the inner wall of the powder passage and to further suppress that the inside of the powder passage is narrowed by the toner base particles and the fine resin particles. Accordingly, the toner base particles are coated with the fine resin particles uniformly, resulting that it is possible to manufacture a resin layer-coated toner having an excellent cleaning property in higher yield.

(Powder Inputting Section and Powder Collecting Section)

Figure 4:
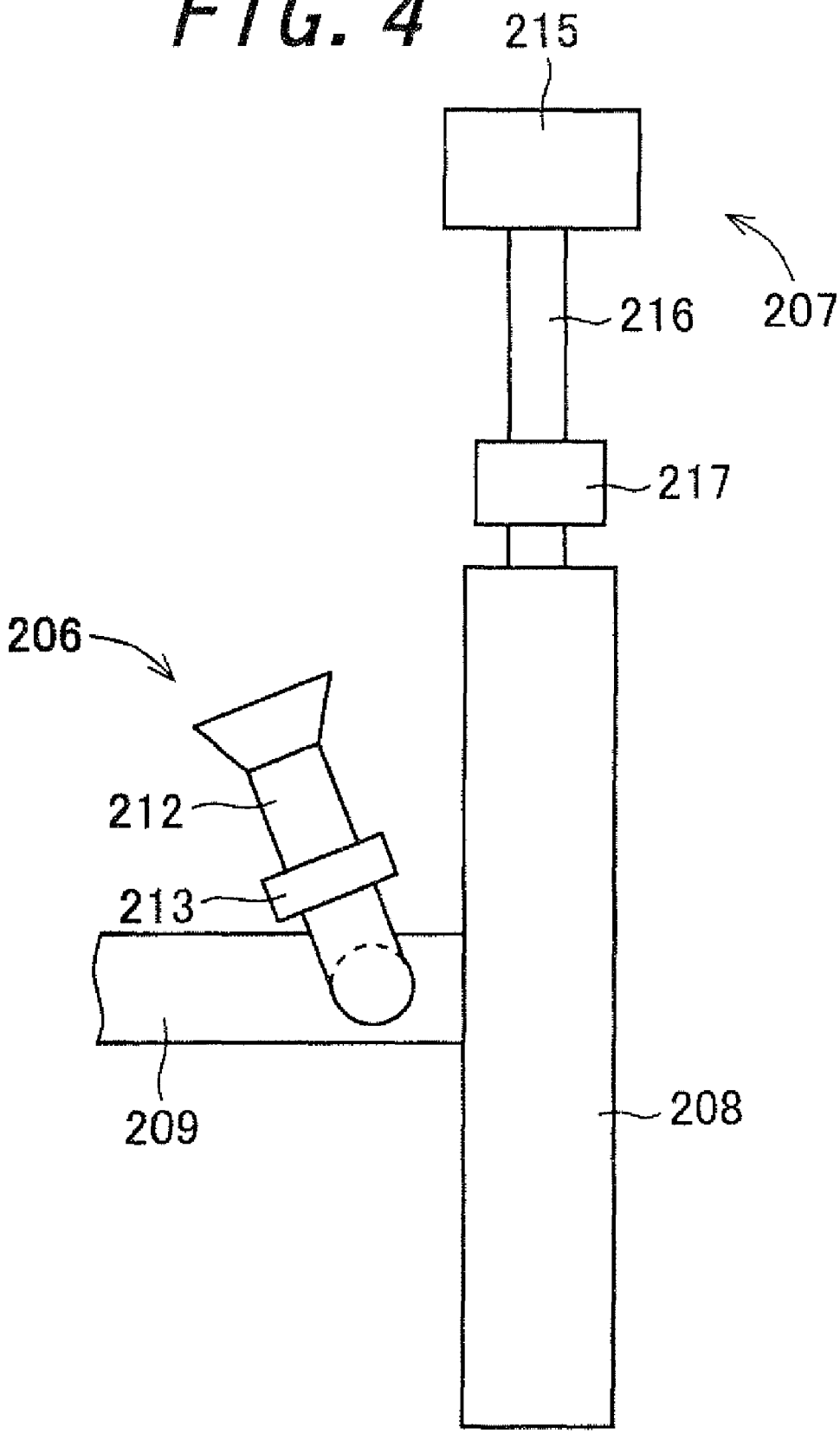
FIG. 4 is a front view of a configuration around the powder inputting section and the powder collecting section.

The powder flowing section 209 of the powder passage 202 is connected to the powder inputting section 206 and the powder collecting section 207. FIG. 4 is a front view of a configuration around the powder inputting section 206 and the powder collecting section 207. The powder inputting section 206 includes a hopper (not shown) that supplies the toner base particles and the fine resin particles, a supplying tube 212 that communicates the hopper and the powder passage 202, and an electromagnetic valve 213 provided in the supplying tube 212. The toner base particles and the fine resin particles supplied from the hopper are supplied to the powder passage 202 through the supplying tube 212 in a state where the passage in the supplying tube 212 is opened by the electromagnetic valve 213. The toner base particles and the fine resin particles supplied to the powder passage 202 flow in the constant powder flowing direction with stirring by the rotary stirring section 204. Moreover, the toner base particles and the fine resin particles are not supplied to the powder passage 202 in a state where the passage in the supplying tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing through the powder passage 202 are not collected in a state where the passage in the collecting tube 216 is closed by the electromagnetic valve 217.

The coating step S3 using the toner manufacturing apparatus 201 as described above includes a temperature regulation step S3*a*, a fine resin particle adhering step S3*b*, a spraying step S3*c*, a film-forming step S3*d*, and a collecting step S3*e*.

(3)-1 Temperature Regulation Step S3*a*

At the temperature regulation step of step S3*a*, while the rotary stirring section 204 is rotated, temperatures in the powder passage 202 and of the rotary stirring section 204 are adjusted to a predetermined temperature by passing a medium through the temperature regulation jacket disposed on the outside thereof. This makes it possible to control the temperature in the powder passage 202 at a temperature or less at which the toner base particles and the fine resin particles that are input at the fine resin particle adhering step S3*b* described below are not softened and deformed.

(3)-2 Fine Resin Particle Adhering Step S3*b*

At the fine resin particle adhering step of step 63*b*, the toner base particles and the fine resin particles are supplied from the powder inputting section 206 to the powder passage 202 in a state where the rotary shaft member 218 of the rotary stirring section 204 is rotated. The toner base particles and the fine resin particles supplied to the powder passage 202 are stirred by the rotary stirring section 204 to flow through the powder flowing section 209 of the powder passage 202 in the direction indicated by an arrow 214. Whereby, the fire resin particles are adhered to the surface of the toner base particles. At this time, by using toner base particles obtained by performing the unprocessed base particle surface treatment processing step S1*b* as the toner base particles, it is possible to adhere the fine resin particles uniformly to the surface of the toner base particles.

3)-3 Spraying Step S3*c*

At the spraying step of step S3*c*, the toner base particles and the fine resin particles in a fluidized state are sprayed with a liquid substance having an effect of plasticizing the particles without dissolving from the spraying section 203 by carrier gas. The spraying section 203 is a two-fluid nozzle. The liquid substance is fed to the spraying section 203 by a liquid feeding pump with a constant flow amount and the liquid substance sprayed by the spraying section 203 is gasified in the powder flowing section and the powder passage 202 so that the gasified substance is spread on the surface of the toner base particles and the fine resin particles. Whereby, the toner base particles and the fine resin particles are plasticized.

(Spray Liquid)

The liquid substance having an effect of plasticizing the toner base particles and the fine resin particles without dissolving is not particularly limited, but is preferably a liquid substance that is easily vaporized since the substance in the form of liquid needs to be removed from the toner base particles and the fine resin particles after the liquid substance is sprayed. An example of the liquid substance includes a liquid substance including a lower alcohol. Examples of the lower alcohol include methanol, ethanol, and propanol. In a case where the liquid substance includes such a lower alcohol, it is possible to enhance wettability of the fine resin particles as a coating material with respect to the toner base particles and adhesion, deformation and film-forming of the fine resin particles are easily performed over the entire surface or a large part of the toner base particles. Further, since the lower alcohol has a high vapor pressure, it is possible to further shorten the drying time at the time of removing the liquid substance and to suppress aggregation of the toner base particles.

In addition, since the viscosity of the liquid substance is reduced by containing alcohol, it is possible, without coarsening the diameter of the sprayed droplet of the liquid substance sprayed by the spraying section, to conduct fine spraying and spray the liquid substance having a uniform droplet diameter. Furthermore, when the toner base particles and the fine resin particles collide with the droplets, it is possible to further promote fining of the diameter of the droplet. Thereby, it is possible to obtain a resin-layer coated toner excellent in uniformity of a coating amount of the fine resin particles serving as the coating material. Accordingly, it is possible to obtain the resin-layer coated toner having a small coarse-particle content and excellent film quality with even higher yield.

Further, the viscosity of the liquid substance is preferably 5 cP or less. A preferable example of the liquid substance having the viscosity of 5 cP or less includes alcohol. Examples of the alcohol include methyl alcohol and ethyl alcohol. These alcohols have the low viscosity and are easily vaporized, and therefore, when the liquid substance includes the alcohol, it is possible to spray the liquid substance with a minute droplet diameter without coarsening a diameter of the spray droplet of the liquid substance to be sprayed from the spraying section 203. It is also possible to spray the liquid substance with a uniform droplet diameter. It is possible to further promote fining of the droplet at the time of collision of the toner base particles and the droplet. This makes it possible to obtain a coated toner having excellent uniformity by uniformly wetting the surfaces of the toner base particles and the fine resin particles and applying the liquid substance to the surfaces of the toner base particles and the fine resin particles and softening the fine resin particles by a multiplier effect with collision energy.

The viscosity of the substance in the form of liquid is measured at 25° C. The viscosity of the substance in the form of liquid can be measured, for example, by a cone/plate type rotation viscometer.

An angle θ formed by the substance in the form of liquid spraying direction which is a direction of the axis of the two-fluid nozzle and the powder flowing direction which is a direction in which the toner base particles and the fine resin particles flow in the powder passage 202 is preferably 0° or more and 45° or less. In a case where the angle θ falls within this range, the droplet of the liquid substance is prevented from recoiling from the inner wall of the powder passage 202 and yield of the toner base particles coated with the resin film is able to be further improved. In a case where the angle θ formed by the liquid spraying direction from the spraying section 203 and the powder flowing direction exceeds 45°, the droplet of the liquid substance easily recoils from the inner wall of the powder passage 202 and the liquid substance is easily retained, thus generating aggregation of the toner particles and deteriorating the yield. The two-fluid nozzle is provided so as to be inserted in the opening formed on the outer wall of the powder passage 202.

Further, a spreading angle Φ of the substance in the form of liquid sprayed by the two-fluid nozzle is preferably 20° or more and 90° or less. In a case where the spreading angle Φ falls out of this range, it is likely to be difficult to spray the substance in the form of liquid uniformly to the toner base particles.

The gasified substance is used to plasticize the toner base particles and the fine resin particles, then continuously exhausted through the through-hole 221 penetrating the inside of the powder passage 202 and the outside of the powder passage 202, and a gas exhausting section 222 along with the carrier gas to the outside of the toner manufacturing apparatus 201 successively. For the gas exhausting section 222, a throttle valve is usable, for example. The through-hole 221 and the gas exhausting section 222 correspond to an exhausting section.

In this embodiment, it is preferable that the liquid substance is started to be sprayed from the spraying section 203 after the flow rate of the toner base particles and the fine resin particles is stabilized in the powder passage 202. Whereby, it is possible to spray the liquid substance to the toner base particles and the fine resin particles uniformly, thus making it possible to improve yield of the toner uniformly coated with the coating layer.

In the embodiment, the carrier gas supplied from the spraying section 203 to the inside of the powder passage 202 pressurizes the inside of the powder passage 202, where pressure $P_1$ in the powder passage 202 is kept in a higher state than pressure $P_0$ outside the powder passage 202. In the embodiment, the outside of the powder passage means the outside of the powder passage where the toner base particles, the fine resin particles and the air flow, that is, the outside of the apparatus. The pressure $P_1$ in the powder passage is preferably higher than normal pressure and the pressure $P_0$ outside the powder passage 202 is preferably the normal pressure or reduced pressure, but in view of keeping the pressure stable, the pressure $P_0$ outside the powder passage 202 is most preferably the normal pressure. The normal pressure as referred herein is so-called atmospheric pressure, that is, approximately 101325 Pa (1 atm).

The carrier gas is introduced from the spraying section 203 to keep the pressure in the inside of the powder passage 202 in a higher state than the pressure outside the powder passage 202 and to exhaust a carrier gas including gasified substance to the outside of the powder passage 202, and at that time, by setting the pressure of the inside of the powder passage 202 higher than the outside of the powder passage 202, it is possible to exhaust the carrier gas including gasified substance stably to the outside of the powder passage 202, which makes it possible to maintain a fluidized state of the toner base particles and the fine resin particles. In addition, it is possible to suppress generation of coarse particles due to a reduced drying speed of the liquid substance, and furthermore, to prevent the toner base particles and the fine resin particles from adhering to the inner wall of the powder passage to aggregate and grow. Accordingly, it is possible to obtain the resin-layer coated toner having a small coarse-particle content and excellent film quality with high yield.

In a case where the carrier gas and the air of the inside of the powder passage 202 are forced to be exhausted using a pump and the like, instead of a pressure difference between the inside of the powder passage 202 and the outside thereof, the toner base particles and the fine resin particles are exhausted along with the carrier gas, which makes it impossible to maintain a fluidized state of the toner base particles and the fine resin particles in the inside of the powder passage 202.

(3)-4 Film-Forming Step

At a film-forming step of step S3*d*, a multiplier effect caused by impact forces of the circulation and stirring by the toner manufacturing apparatus 201, and in addition, thermal energy due to the stirring soften the fine resin particles to be a continuous film, and the rotary stirring section 204 keeps stirring at a predetermined temperature, until a resin film is formed on the toner base particles, to fluidize the toner base particles and the fine resin particles. At the step, similarly to the fine resin particle adhering step S3*b*, the carrier gas including the carrier gas including the gasified substance is exhausted to the outside of the powder passage 202 and the pressure in the inside of the powder passage 202 is set to a higher state than the pressure outside the powder passage 202.

(3)-5 Collecting Step

At the collecting step of step S3*e*, spraying of the liquid substance from the spraying section is finished, rotation of the rotary stirring section 204 is stopped, the resin layer-coated toner is ejected outside the apparatus from the powder collecting section 207, and the resin layer-coated toner is collected.

In this way, the resin layer-coated toner is manufactured, but the peripheral speed of the outermost peripheral of the rotary stirring section 204 at the coating step S3 including steps S3*a* to S3*e* is preferably set to 30 m/sec or more, and more preferably to 50 m/sec or more. The outermost peripheral of the rotary stirring section 204 is a part 4*a* of the rotary stirring section 204 that has the longest distance from the axis of the rotary shaft member 218 in the direction perpendicular to the extending direction of the rotary shaft member 218 of the rotary stirring section 204. In a case where the peripheral speed in the outermost peripheral of the rotary stirring section 204 is at 30 m/sec or more at the time of rotation, it is possible to isolate and fluidize the toner base particles. In a case where the peripheral speed in the outermost peripheral is less than 30 m/sec, it is impossible to isolate and fluidize the toner base particles and the fine resin particles, thus making it impossible to uniformly coat the toner base particles with the resin film.

Further, at the coating step S3, the temperature regulation jacket is provided at least on a part of outside of the powder passage 202 and a temperature in the powder passage 202 is adjusted to a predetermined temperature by passing a cooling medium or a heating medium through the internal space of the jacket. This makes it possible at the temperature regulation step S3*a* to control the temperature in the powder passage and outside of the rotary stirring section to a temperature or less at which the toner base particles and the fine resin particles that are input at the fine resin particle adhering step S3*b* are not softened and deformed. At the spraying step S3*c* and the film-forming step S3*d*, a variation in the temperature applied to the toner base particles, the fine resin particles and the liquid substance is reduced and it is possible to keep the stable fluidized state of the toner base particles and the fine resin particles.

Furthermore, the toner base particles and the fine resin particles, comprising a synthetic resin or the like generally collide with the inner wall of the powder passage many times. At the collision, a part of collision energy is converted into heat energy, and the heat energy stored in the toner base particles and the fine resin particles. With increasing the number of collision, the heat energy stored in those particles is increased, and then the toner base particles and the fine resin particles get soft and adhere to the inner wall of the powder passage. However, by passing a cooling medium or a heating medium through the space in the jacket to regulate the temperature as described before, adhesion force of the toner base particles and the fine resin particles to the inner wall of the powder passage is reduced. As a result, adhesion of the toner base particles to the inner wall of the powder passage 202 due to rapid increase in temperature in the apparatus can surely be prevented, and the powder passage can be suppressed form being narrowed by the toner base particles and the fine resin particles. Accordingly, the toner base particles are uniformly covered with the fine resin particles, and a toner covered with a resin layer can be manufactured with high yield.

In the inside of the powder flowing section 209 downstream of the spraying section 203, the sprayed liquid substance is not dried and is retained, and the drying speed is made slow with an improper temperature and the liquid substance is easily retained, and when the toner base particles are in contact therewith, the toner base particles are easily adhered to the inner wall of the powder passage 202. This may be an aggregation generation source, of the toner base particles. In the inner wall near the opening section 210, the toner base particles that flow in the powder flowing section 209 and flow into the stirring section 208 from the opening section 210 easily collide with the toner base particles that flow in the stirring section 208 with stirring of the rotary stirring section 204. Whereby, the collided toner base particles are easily adhered to the vicinity of the opening section 210. Accordingly, by providing the temperature regulation jacket in such a part where the toner base particles are easily adhered, it is possible to prevent the toner base particles from being adhered to the inner wall of the powder passage 202 more reliably.

The temperature in the powder passage 202 is set to a glass transition temperature of the toner base particles or less. Further, the temperature in the powder passage 202 is more preferably not more than a glass transition temperature of the toner base particles of 30° C. or more. The temperature in the powder passage 202 is almost uniform at any part in the powder passage 202 by the flow of the toner base particles. In a case where the temperature in the powder passage 202 exceeds the glass transition temperature of the toner base particles, there is a possibility that the toner base particles in the powder passage 202 are softened excessively and aggregation of the toner base particles is generated. Further, in a case where the temperature in the powder passage 202 is less than 30° C., there is a possibility that the drying speed of a dispersion liquid is made slow and the productivity is lowered. Accordingly, in order to prevent aggregation of the toner base particles, it is necessary that the temperature regulation jacket whose inner diameter is larger than an external diameter of the powder passage tube is disposed at least on a part of the outer side of the powder passage tube and the rotary stirring section 204 and an apparatus is provided that has a function of adjusting the temperature by passing a cooling medium or a heating medium through the space thereof so as to maintain the temperature of the powder passage 202 and the rotary stirring section to the glass transition temperature of the toner base particles or less.

As described above, the rotary stirring section 204 includes the rotary disc 219 that is rotated with rotation of the rotary shaft member 218, and the toner base particles and the fine resin particles preferably collide with the rotary disc 219 vertically to the rotary disc 219, and more preferably collide with the rotary shaft member 218 vertically to the rotary disc 219. Whereby, it is possible to stir the toner base particles and the fine resin particles more sufficiently than the case where the toner base particles and the fine resin particles collide with the rotary disc 219 in parallel, thus making it possible to coat the toner base particles with the fine resin particles more uniformly and to further improve yield of the toner uniformly coated with the coating layer.

In this embodiment, the substance in the form of liquid sprayed in the spraying step S3*c* is preferably gasified to have a constant gas concentration in the powder passage 202. Whereby, the concentration of the gasified substance in the powder passage 202 is kept constant and it is possible to make the drying speed of the liquid substance higher than the case where the concentration of the gasified substance is not kept constant, thus making it possible to prevent that the toner particles in which an undried liquid substance is remained are adhered to other toner particles and to further suppress aggregation of the toner particles. As a result, it is possible to further improve yield of the toner uniformly coated with the coating layer.

The concentration of the gasified substance measured by a concentration sensor in a gas exhausting section 222 preferably around 3% or less. In a case where the concentration of the gasified substance is around 3% or less, the drying speed of the liquid substance is able to be increased sufficiently, thus making it possible to prevent adhesion of the undried toner base particles in which the liquid substance is remained to other toner base particles and to prevent aggregation of the toner base particles. Moreover, the concentration of the gasified substance in the gas exhausting section 222 is more preferably 0.1% or more and 3.0% or less by the concentration sensor. In a case where the spraying speed falls within this range, it is possible to prevent aggregation of the toner base particles without deteriorating the productivity.

The gasified substance is continuously exhausted to the outside of the powder passage 202 so as to keep a gas concentration constant in the inside of the powder passage 202. At the time, the pressure $P_1$ in the powder passage 202 and the pressure $P_0$ outside the powder passage 202 satisfy the following formula (1).

$$0\ \text{atm} < (\text{Pressure } P_1 \text{ in the powder passage} - \text{Pressure } P_0 \text{ outside the powder passage}) \leqq 0.3\ \text{atm} \quad (1)$$

When a difference between the pressure $P_1$ in the powder passage 202 and the pressure $P_0$ outside the powder passage 202 is 0 atm or less, that is, the pressure $P_1$ in the powder passage 202 is equal to the normal pressure or in a state of reduced pressure, it is impossible to stably exhaust the carrier gas including gasified substance to the outside of the powder passage 202, which makes the fluidized state of the toner base particles and the fine resin particles unstable. When the difference between the pressure $P_1$ in the powder passage 202 and the pressure $P_0$ outside the powder passage 202 exceeds 0.3 atm and the pressure in the powder passage becomes too high, the liquid substance to plasticize the toner base particles and the fine resin particles becomes difficult to be gasified, and even when gasified, becomes difficult to be exhausted from the inside of the powder passage, thus the gasified substance is absorbed inside the toner base particles and the fine resin particles to generate an aggregate, as a result, the ratio of a coarse-powder content is increased and the coating uniformity and the yield are lowered. When the pressure $P_1$ in the powder passage 202 and the pressure $P_0$ outside the powder passage 202 satisfy the above-described formula (1), it is thereby possible to make spraying state of the liquid substance and exhausting state of the carrier gas including gasified substance to the outside of the powder passage 202 excellent. Accordingly, it is possible to obtain the resin-layer coated toner having a small coarse-particle content and excellent film quality with higher yield. Furthermore, the difference between the pressure $P_1$ in the powder pa sage 202 and the pressure $P_0$ outside the powder passage 202 is more preferably 0.03 atm or more and 0.25 atm or less.

The configuration of such a toner manufacturing apparatus 201 is not limited to the above and various alterations may be added thereto. For example, the temperature regulation jacket may be provided over the outside of the powder flowing section 209 and the stirring section 208, or may be provided in a part of the outside of the powder flowing section 209 or the stirring section 208. In a case where the temperature regulation jacket is provided over the outside of the powder flowing section 209 and the stirring section 208, it is possible to prevent the toner base particles from being adhered to the inner wall of the powder passage 202 more reliably.

The toner manufacturing apparatus as described above can be also obtained by combining a commercially available stirring apparatus and the spraying section. An example of the commercially available stirring apparatus provided with a powder passage and a rotary stirring section includes HYBRIDIZATION SYSTEM (trade name) manufactured by Nara Machinery Co., Ltd. By installing a liquid spraying unit in the stirring apparatus, the stirring apparatus is usable as the toner manufacturing apparatus used for the method for manufacturing a toner of the invention.

2. Resin Layer Coating Toner

A toner or a second embodiment of the invention is manufactured by the method for manufacturing the toner of the first embodiment. In the toner obtained by the method for manufacturing the toner of the first embodiment, an amount of the fine resin particles serving as the coating material to coat the toner base particles is uniform so that toner properties such as chargeability between individual particles of the resin-layer coated toner become uniform. Furthermore, the resin-layer coated toner of the invention has an effect to protect a contained component by the resin layer on the surface of the toner to be excellent in durability. When an image is formed using such a resin-layer coated toner, it is possible to stably form an image that is highly-defined with no density unevenness and excellent in image quality.

To the toner of the invention, an external additive may be added. As the external additive, heretofore known substances can be used including silica and titanium oxide. It preferred that these substances be surface-treated with silicone resin and a silane coupling agent. A preferable usage of the external additive is 1 part by weight to 10 parts by weight based on 100 parts by weight the toner.

3. Developer

A developer according to a third embodiment of the invention includes the toner according to the second embodiment. This makes it possible that a developer has uniform toner characteristics such as charging characteristics between individual toner particles, thus obtaining a developer capable of maintaining excellent development performance. The developer of the embodiment can be used in form of either one-component developer or two-component developer. In the case where the developer is used in form of one-component developer, only the toner is used without carriers while a blade and a fur brush are used to effect the fictional electrification at a developing sleeve so that the toner is attached onto the sleeve, thereby conveying the toner to perform image formation. Further, in the case where the developer is used in form of two-component developer, the toner of a second embodiment is used together with a carrier. Since the toner of the invention has uniform toner characteristics such as charging characteristics between individual toner particles, it is possible to stably form an image having high definition and excellent image quality without unevenness in density.

(Carrier)

As the carrier, heretofore known substances can be used including, for example, single or complex ferrite composed of iron, copper, zinc, nickel, cobalt, manganese, and chromium; a resin-coated carrier having carrier core particles whose surfaces are coated with coating substances; or a resin-dispersion carrier in which magnetic particles are dispersed in resin.

As the coating substance, heretofore known substances can be used including polytetrafluoroethylene, a monochloro-trifluoroethylene polymer, polyvinylidene-fluoride, silicone resin, polyester, a metal compound of di-tertiary-butylsalicylic acid, styrene resin, acrylic resin, polyamide, polyvinyl butyral, nigrosine, aminoacrylate resin, basic dyes or lakes thereof, fine silica powder, and fine alumina powder. In addition, the resin used for the resin-dispersion carrier is not limited to particular resin, and examples thereof include styrene-acrylic resin, polyester resin, fluorine resin, and phenol resin. Both of the coating substance in the resin-coated carrier and the resin used for the resin-dispersion carrier are preferably selected according to the toner components. Those substances and resin listed above may be used each alone, and two or more thereof may be used in combination.

A particle of the carrier preferably has a spherical shape or flattened shape. A particle size of the carrier not limited to a particular diameter, and in consideration of forming higher-quality images, the particle size of the carrier is preferably 10 μm to 100 μm and more preferably 20 μm to 50 μm. Further, the resistivity of the carrier is preferably $10^8 \Omega \cdot cm$ or more, and more preferably $10^{12} \Omega \cdot cm$ or more.

The resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container as just stated. When an electric field of 1,000 V/cm is generated between the weight and a bottom electrode of the container by application of voltage, a current value is read. The current value indicates the resistivity of the carrier. When the resistivity of the carrier is low, electric charges will be injected into the carrier upon application of bias voltage to a developing sleeve, thus causing the carrier particles to be more easily attached to the photoreceptor. In this case, the breakdown of bias voltage is more liable to occur.

Magnetization intensity (maximum magnetization) of the carrier is preferably 10 emu/g to 60 emu/g and more preferably 15 emu/g to 40 emu/g. The magnetization intensity depends on magnetic flux density of a developing roller. Under the condition of ordinary magnetic flux density of the developing roller, however, no magnetic binding force work on the carrier having the magnetization intensity less than 10 emu/g, which may cause the carrier to spatter. The carrier having the magnetization intensity larger than 60 emu/g has bushes which are too large to keep the non-contact state with the image bearing member in the non-contact development or to possibly cause sweeping streaks to appear on a toner image in the contact development.

A use ratio of the toner to the carrier in the two-component developer is not limited to a particular ratio, and the use ratio is appropriately selected according to kinds of the toner and carrier. To take the resin-coated carrier (having density of 5 $g/cm^2$ to 8 $g/cm^2$) as an example, the usage of the toner may be determined such that a content of the toner in the developer is 2% by weight to 30% by weight and preferably 2% by weight to 20% by weight of the total amount of the developer. Further, in the two-component developer, coverage of the carrier with the toner is preferably 40% to 80%.

4. Image Forming Apparatus

Figure 5:
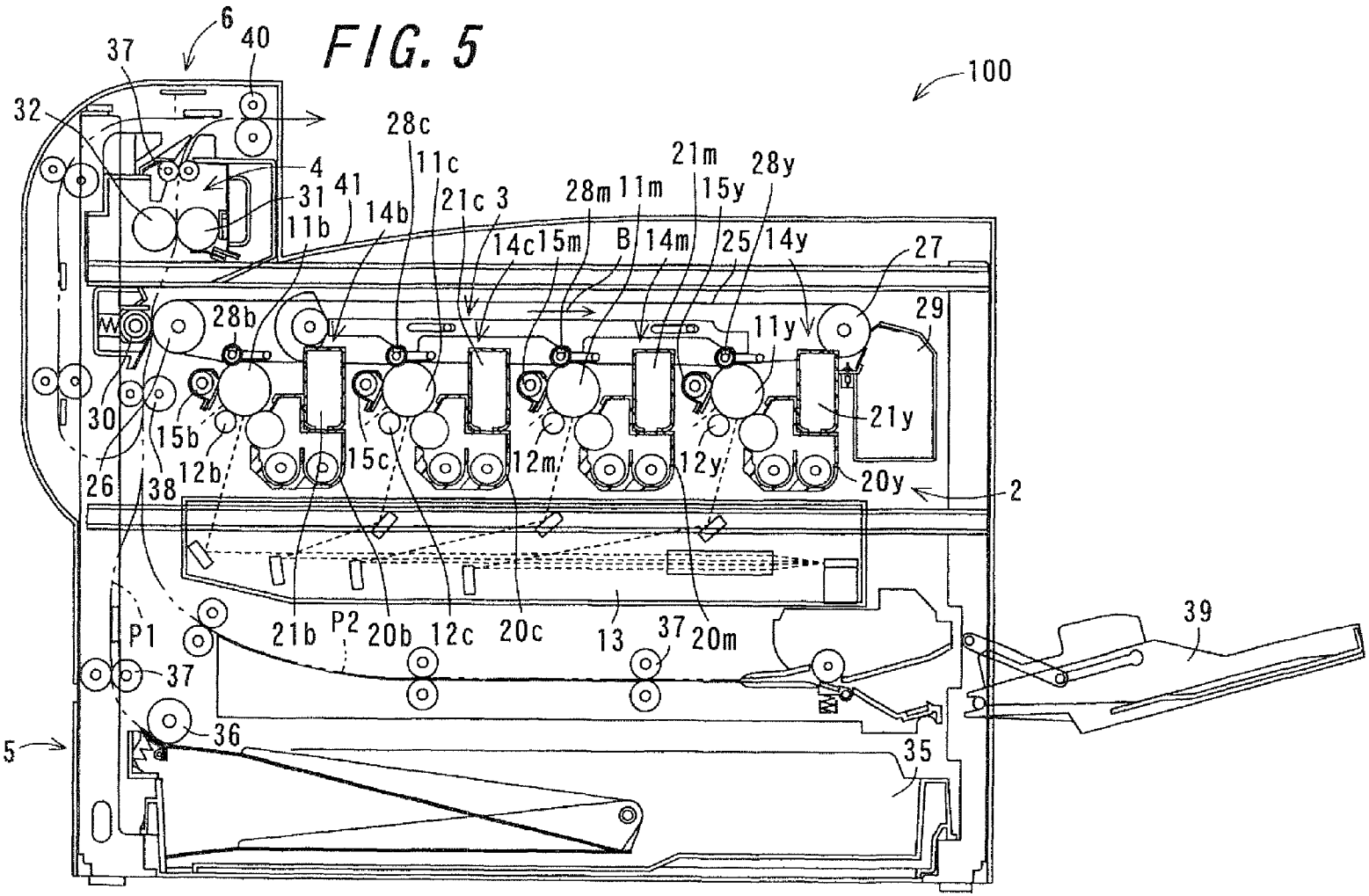
FIG. 5 is a sectional view schematically showing a configuration of an image forming apparatus according to a fourth embodiment of the invention.

FIG. 5 is a sectional view schematically showing a configuration of an image forming apparatus 100 according to a fourth embodiment of the invention. The image forming apparatus 100 is a multifunctional system which combines a copier function, a printer function, and a facsimile function. In the image forming apparatus 100, according to image information transmitted thereto, a full-color or black-and-white image is formed on a recording medium. To be specific, three print modes, i.e., a copier mode, a printer mode, and a facsimile mode are available in the image forming apparatus 100, one of which print modes is selected by a control unit (not shown) in response to an operation input given by an operating section (not shown) or a print job given by a personal computer, a mobile computer, an information record storage medium, or an external equipment having a memory unit.

The image forming apparatus 100 includes a photoreceptor drum 11, a toner image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The toner image forming section 2 includes a charging section 12, an exposure unit 13, a developing device 14, and a cleaning unit 15. The charging section 12 and the exposure unit 13 functions as a latent image forming section. The charging section 12, the developing device 14, and the cleaning unit 15 are disposed in the order just stated around the photoreceptor drum 11. The charging section 12 is disposed vertically below the developing device 14 and the cleaning unit 15.

The photoreceptor drum 11 is a roller-like member provided so as to be capable of rotationally driving around an axis by a rotary driving section (not shown) and on the surface of which an electrostatic latent image is formed. The rotary driving section of the photoreceptor drum 11 is controlled by a controlling section that is realized by a central processing unit (CPU). The photoreceptor drum 11 is comprised of a conductive substrate (not shown) and a photosensitive layer formed on the surface of the conductive substrate. The conductive substrate may be various shapes including a cylindrical shape, a columnar shape, or a thin film sheet shape, for ample. Among them, the cylindrical shape is preferable. The conductive substrate is formed by a conductive material.

As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the chargeability of the photosensitive layer can be enhanced under at least either a low temperature circumstance or a low humidity circumstance. Further, a laminated photoreceptor is also applicable which has a highly-durable three-layer structure having a photoreceptor surface-protecting layer provided on the top layer.

The charge generating layer contains as a main substance a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination. The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, poiyallylate, polyamide, and polyester. The binder resin may be used each alone or optionally two or more of them may be used in combination.

The charge generating layer can be formed by dissolving or dispersing an appropriate amount of a charge generating substance, binder resin and, optionally, a plasticizer, a sensitizer, etc., respectively in an appropriate organic solvent which is capable of dissolving or dispersing the substances described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm and more preferably from 0.1 μm to 2.5 μm.

The charge transporting layer stacked over the charge generating layer contains as essential substances a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chioranil, and benzoquinone, The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer.

As the binder resin for charge transporting layer, is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resin may be used each alone, or two or more of them may be used in combination.

The charge transporting layer preferably contains an antioxidant together with the charge transporting substance and the binder resin for charge transporting layer. Also for the antioxidant, substances used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each atone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer.

The charge transporting layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm.

Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of farming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 longitudinally along the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed pressure-contact with the photoreceptor drum. It is also possible to use a contact-charging type charger such as a charging brush or a magnetic brush.

The exposure unit 13 is disposed so that a light beam corresponding to each color information emitted from the exposure unit 13 passes between the charging section 12 and the developing device 14 and reaches the surface of the photoreceptor drum 11. In the exposure unit 13, the image information is converted into light beams corresponding to each color information of black, cyan, magenta, and yellow, and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array or a unit in which a liquid-crystal shutter and a light source are appropriately combined with each other.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus 100 of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of the charging section. The degraded Surface part is, however, worn away by abrasion through the cleaning unit 15 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of toner image forming operations just described are repeatedly carried out.

The transfer section 3 is disposed above the photoreceptor drum 11 and includes the intermediate transfer belt 25, a driving roller 26, a driven roller 27, an intermediate transferring roller 28*b*, 28*c*, 28*m*, 28*y*, a transfer belt cleaning unit 29, and a transferring roller 30. The intermediate transfer belt 25 is an endless belt stretched between the driving roller 26 and the driven roller 27, thereby forming a loop-shaped travel path. The intermediate transfer belt 25 rotates in an arrow B direction. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 with the intermediate transfer belt 25 interposed therebetween, and capable of rotating around its own axis by a drive mechanism (not shown). The intermediate transferring roller 28 is connected to a power source Knot shown) for applying the transfer bias voltage as described above, and has a function of transferring the toner image formed on the surface of the photoreceptor drum 11 to the intermediate transfer belt 25.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transferring roller 28 which is disposed opposite to the photoreceptor drum 11 with the intermediate transfer belt 25 interposed therebetween, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image.

The transfer belt cleaning unit 29 is disposed opposite to the driven roller 27 with the intermediate transfer belt 25 interposed therebetween so as to come into contact with an outer circumferential surface of the intermediate transfer belt 25. When the intermediate transfer belt 25 contacts the photoreceptor drum 11, the toner is attached to the intermediate transfer belt 25 and may cause contamination on a reverse side of the recording medium, and therefore the transfer belt cleaning unit 29 removes and collects the toner on the surface of the intermediate transfer belt 25.

The transferring roller 30 is disposed in pressure-contact with the driving roller 26 with the intermediate transfer belt 25 interposed therebetween, and capable of rotating around its own axis by a drive mechanism (not shown). In a pressure-contact region (a transfer nip region) between the transferring roller 30 and the driving roller 26, a toner image which has been borne by the intermediate transfer belt 25 and thereby conveyed to the pressure-contact region is transferred onto a recording medium fed from the later-described recording medium feeding section 5. The recording medium bearing the toner image is fed to the fixing section 4.

In the transfer section 3, the toner image is transferred from the photoreceptor drum 11 onto the intermediate transfer belt 25 in the pressure-contact region between the photoreceptor drum 11 and the intermediate transferring roller 28, and by the intermediate transfer belt 25 rotating in the arrow B direction, the transferred toner image is conveyed to the transfer nip region where the toner image is transferred onto the recording medium.

The fixing section 4 is provided downstream of the transfer section along a conveyance direction of the recording medium, and contains a fixing roller 31 and a pressure roller 32. The fixing roller 31 can rotate by a drive mechanism (not shown), and heats and fuse the toner constituting an unfixed toner image borne on the recording medium. Inside the fixing roller 31 is provided a heating portion (not shown). The heating portion heats the heating roller 31 so that a surface of the heating roller 31 has a predetermined temperature (heating temperature). For the heating portion, a heater, a halogen lamp, and the like device can be used, for example. The heating portion is controlled by the fixing condition controlling portion.

In the vicinity of the surface of the fixing roller 31 is provided a temperature detecting sensor (not shown) which detects a surface temperature of the fixing roller 31. A result detected by the temperature detecting sensor is written to a memory portion of the later-described control unit. The pressure roller 32 is disposed in pressure-contact with the fixing roller 31, and supported so as to be driven to rotate by the rotation of the fixing roller 31. The pressure roller 32 fixes the toner image to the recording medium in cooperation with the fixing roller 31. At this time, the pressure roller 32 helps the toner image to be fixed onto the recording medium by pressing the toner image in a fused state by heat from the fixing roller 31 against the recording medium. A pressure-contact region between the fixing roller 31 and the pressure roller 32 is a fixing nip region.

In the fixing section 4, the recording medium onto which the toner image has been transferred in the transfer section 3 is nipped by the fixing roller 31 and the pressure roller 32 so that when the recording medium passes through the fixing nip region, the toner image is pressed and thereby fixed Onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path S1. The conveying rollers 37 are a pair of roller members disposed in pressure-contact with each other, and convey the recording medium toward the registration rollers 38. The registration rollers 38 are a pair of roller members disposed in pressure-contact with each other, and feed the recording medium fed from the conveying rollers 37 to the transfer nip region in synchronization with the conveyance of the toner image borne on the intermediate transfer belt 25 to the transfer nip region. The manual paper feed tray 39 is a device for storing recording mediums so as to take them into the image forming apparatus 100, and the recording mediums stored in the manual paper feed tray 39 are different from the recording mediums stored in the automatic paper feed tray 35 and may have any size. The recording medium taken in from the manual paper feed tray 39 passes through a paper conveyance path 22 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The recording medium discharging section 6 includes the conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 100. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are input, for example, various set values obtained by way of an operation panel (not shown) disposed on the upper surface of the image forming apparatus 100, results detected from a sensor (not shown) etc. disposed in various portions inside the image forming apparatus 100, and image information obtained from an external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disk drive (HDD). For the external equipment, it is possible to use electrical and electronic devices which can form or obtain the image information and which can be electrically connected to the image forming apparatus 100. Examples of the external equipment include a computer, a digital camera, a television receiver, a video recorder, a DVD (digital versatile disc) recorder, an HDDVD (high-definition digital versatile disc), a Blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit. The control unit contains a main power source as well as above-stated processing circuit. The power source supplies electricity to not only the control unit but also respective devices provided inside the image forming apparatus 100.

5. Developing Device

Figure 6:
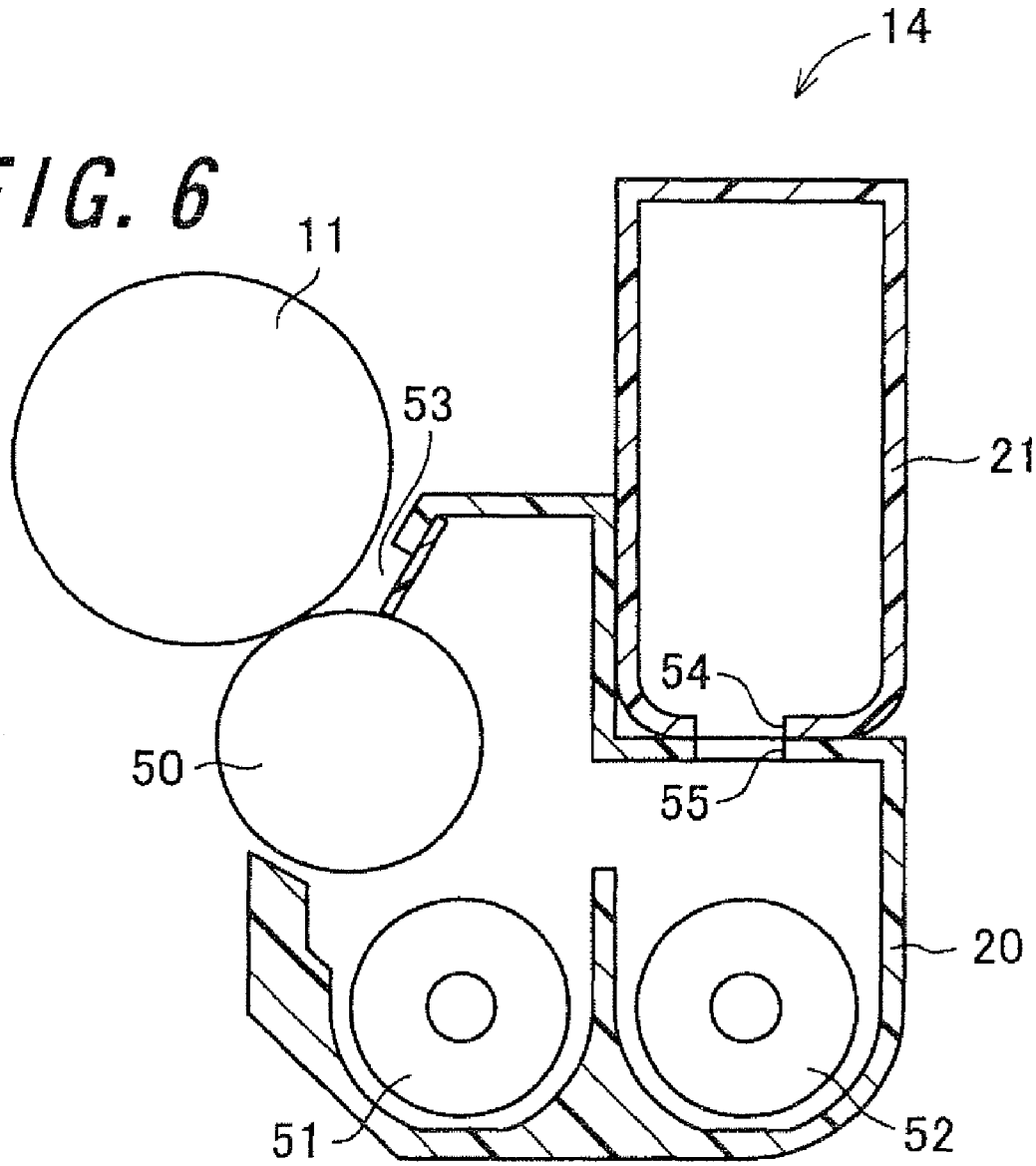
FIG. 6 is a schematic view schematically showing the developing device provided in the image forming apparatus shown in FIG. 5.

FIG. 6 is a schematic view schematically showing the developing device 14 provided in the image forming apparatus 100 shown in FIG. 5. The developing device 14 includes a developing tank 20 and a toner hopper 21. The developing tank, 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller 50, a supplying roller 51, and an agitating roller 52. Moreover, a screw member may be stored instead of the roller-like member. The developing device 14 of this embodiment stores the toner of the above one embodiment in the developing tank 20 as a toner.

The developing tank 20 has an opening 53 in a side face thereof opposed to the photoreceptor drum 11. The developing roller 50 is rotatably provided at such a position as to face the photoreceptor drum 11 through the opening 53 just stated. The developing roller 50 is a roller-shaped member for supplying a toner to the electrostatic latent image on the surface of the photoreceptor drum 11 in a pressure-contact region or most-adjacent region between the developing roller 50 and the photoreceptor drum 11. In supplying the toner, to a surface of the developing roller 50 is applied potential whose polarity is opposite to polarity of the potential of the charged toner, which serves as development bias voltage. By so doing, the toner on the surface of the developing roller 50 is smoothly supplied to the electrostatic latent image. Furthermore, an amount of the toner being supplied to the electrostatic latent image can be controlled by changing a value of the development bias voltage.

The supplying roller 51 is a roller-shaped member which is rotatably disposed so as to face the developing roller 50 and used to supply the toner to the vicinity of the developing roller 50.

The agitating roller 52 is a roller-shaped member which is rotatably disposed so as to face the supplying roller 51 and used to feed to the vicinity of the supplying roller 51 the toner which is newly supplied from the toner hopper 21 into the developing tank 20. The toner hopper 21 is disposed so as to communicate a toner replenishment port 54 formed in a vertically lower part of the toner hopper 21, with a toner reception port 55 formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

As described above, since the developing device 14 develops a latent image using the developer of the invention, it is possible to stably form a high-definition toner image on the photoreceptor drum 11. As a result, it is possible to form a high-quality image stably.

Further, according to the invention, the image forming apparatus 100 is implemented by including the photoreceptor drum 11 on which a latent image is formed, the charging section 12 that forms the latent image on the photoreceptor drum 11, the exposure unit 13, and the developing device 14 of the invention capable of forming a high-definition toner image on the photoreceptor drum 11 as described above. By forming an image with such an image forming apparatus 100, it is possible to form an image having high definition and excellent image quality without unevenness in density.

EXAMPLES

Hereinafter, referring to examples and comparative examples, the invention will be specifically described. In the following description, unless otherwise noted, "parts" and "%" represent "parts by weight" and "% by weight" respectively. In the examples and the comparative examples, a glass transition temperature of the binder resin and the toner base particles, a softening temperature of the binder resin, a melting point of the release agent, and a volume average particle size of the toner base particles were measured as follows.

(Property Measurement)

[Glass Transition Temperature of Binder Resin and Toner Base Particle]

Using a differential scanning calorimeter (trade name: DSC220, manufactured by Seiko Instruments & Electronics Ltd.), 1 g of specimen was heated at a temperature increasing rate of 10° C./min to measure a DSC curve based on Japanese Industrial Standards (JIS) K7121-1987. A temperature at an intersection of a straight line that was elongated toward a low-temperature side from a base line on the high-temperature side of an endothermic peak corresponding to glass transition of the obtained DSC curve and a tangent line that was drawn so that a gradient thereof was maximum, against a curve extending from a rising part to a top of the peak was obtained as the glass transition temperature ($T_g$).

[Softening Temperature of Binder Resin]

Using a flow characteristic evaluation apparatus (trade name: FLOW TESTER CFT-100C, manufactured by Shimadzu Corporation), 1 g of specimen was heated at a temperature increasing rate of 6° C./min, under load of 20 kgf/cm$^2$ ($19.6\times10^5$ Pa) so that the specimen was pushed out of a dye (nozzle opening diameter of 1 mm and length of 1 mm) and a temperature at the time when a half of the specimen had flowed out of the dye was obtained as the softening temperature ($T_m$).

[Melting Point of Release Agent]

Using the differential scanning calorimeter (trade name: DSC220, manufactured by Seiko Instruments & Electronics Ltd.), 1 g of specimen was heated from a temperature of 20 up to 200° C. at a temperature increasing rate of 10° C./min, and then an operation of rapidly cooling down from 200° C. to 20° C. was repeated twice, thus measuring a DSC curve. A temperature at a top of an endothermic peak corresponding to the melting on the DSC curve measured at the second operation, was obtained as the melting point of the release agent.

[Volume Average Particle Size of Toner Base Particles]

To 50 ml of electrolyte (trade name: ISOTON-II, manufactured by Beckman Coulter, Inc.), 20 mg of specimen and 1 ml of sodium alkylether sulfate ester were added, and a thus-obtained admixture was subjected to dispersion processing of an ultrasonic distributor (trade name: desktop two-frequency ultrasonic cleaner VS-D100, manufactured by AS ONE Corporation) for three minutes at an ultrasonic frequency of 20 kHz, thereby preparing a specimen for measurement. The measurement sample was analyzed by a particle size distribution-measuring device: MULTISIZER III (trade name) manufactured by Beckman Coulter, Inc. under the conditions that an aperture diameter was 100 μm and the number of particles for measurement was 50,000 counts. A volume particle size distribution of the sample particles was thus obtained from which the volume average particle size was then determined.

[Volume Average Particle Size of Fine Resin Particles]

To measure the volume average particle size of the fine resin particles, a laser diffraction/scattering type grain size distribution measuring apparatus (trade name: Microtrac MT3000 manufactured by NIKKISO Co., Ltd.) was used. To prevent aggregation of the measurement sample (fine resin particle), a dispersion liquid in which the measurement sample is dispersed in an aqueous solution containing FAMILY FRESH (manufactured by Kao Corporation) is input and stirred, then put into the apparatus, the measurement was conducted twice to obtain the average value. As measuring conditions, the measurement time was 30 seconds, a refractive index of sample particles was 1.49, a dispersion medium was water, and the refractive index of the dispersion medium was 1.33. A volume grain size distribution of the measurement sample was measured and from the measurement result, a particle size whose accumulated volume from a small particle size side in an accumulated volume distribution was 50% was calculated as a volume average particle size (μm) of the fine resin particle.

Example 1

[Toner Base Particle Preparation Step S1]

Raw materials of the toner base particles and addition amounts thereof were as follows:

| | |
|---|---|
| Polyester resin (trade name: DIACRON, manufactured by Mitsubishi Rayon Co., Ltd., glass transition temperature of 55° C., softening temperature of 130° C.) | 87.5% (100 parts) |
| C.I. Pigment Blue 15:3 | 5.0% (5.7 parts) |
| Release agent (Carunauba Wax, melting point of 82° C.) | 6.0% (6.9 parts) |
| Charge control agent (tradename: Bontron E84, manufactured by Orient Chemical Industries, Ltd.) | 1.5% (1.7 parts) |

After pre-mixing each of the constituent materials described above by a Henschel mixer (trade name: FM20C, manufactured by Mitsui Mining Co., Ltd.), the obtained mixture was melt and kneaded by a twin-screw extruder (trade name: PCM65 manufactured by Ikegai, Ltd.). After coarsely pulverizing the melt-kneaded material by a cutting mill (trade name: VM-16, manufactured by Orient Co., Ltd.), it was finely pulverized by a jet mill (manufactured by Hosokawa Micron Corporation) and then classified by a pneumatic classifier (manufactured by Hosokawa Micron Corporation) to prepare toner base particles with a volume average particle size of 6.5 μm and a glass transition temperature of 56° C. The average degree of circularity of the toner base particles was 0.945.

[Fine Resin Particle Preparation Step S2]

A polymer of styrene, acrylic acid and butyl acrylate was freeze-dried to make fine resin particles, thereby obtaining styrene-acrylic acid-butyl acrylate copolymer fine particles A (glass transition temperature of 64° C. and softening temperature of 120° C.) with a volume average particle size of 0.15 μm.

[Coating Step S3]

A rotary stirring apparatus in which a liquid spraying unit including the two-fluid nozzle is installed in HYBRIDIZATION SYSTEM (trade name: NHS-1 type, manufactured by Nara Machinery Co., Ltd.) in accordance with the apparatus shown in FIG. 2, was used. For the liquid spraying unit, the one that is connected so as to feed the liquid substance quantitatively through a liquid feeding pump (trade name: SP11-12, manufactured by FLOM Co., Ltd.) to the two-fluid nozzle, was used. An installation angle of the two-fluid nozzle was set such that an angle formed by a spraying direction of the liquid and a flowing direction of the powder (hereinafter, referred to as "spraying angle") was in parallel (0°). While the toner base particles and the fine resin particles were stirred and in a fluidized state, spraying was conducted and ethanol was used as a liquid substance to plasticize such particles. A spraying speed of the liquid substance and an exhausting speed of the carrier gas including gasified substance were able to be observed using a commercially-available gas detector (trade name: XP-3110, manufactured by New Cosmos Electric Co., Ltd.). The temperature regulation jacket was provided over the entire surface of the powder flowing section and the wall face of the stirring section. A temperature sensor was installed in the powder passage.

At the temperature regulation step S3*a*, the temperature of the powder flowing section and the stirring section was adjusted so as to be 50° C. At the fine resin particle adhering step S3*b*, the peripheral speed was set to 100 m/sec on the outermost peripheral of the rotary stirring section in the Hybridization System of the apparatus. The peripheral speed at the spraying step S3*c* and film-forming step S3*d* was also set to 100 m/sec.

The apparatus stirred and mixed 100 parts by weight of toner base particles and 10 parts by weight of fine resin particles for 5 minutes, then ethanol as the liquid substance was sprayed at a spraying speed of 1.0 g/min with an air flow of 5 L/min for 30 minutes to form a film of the fine resin particles on the surface of the toner base particles. Thereafter, spraying ethanol was stopped, followed by stirring for 10 minutes, to obtain the resin-layer coated toner of Example 1.

A pressure difference between the inside of the powder passage and the outside of the powder passage at the time of manufacturing the resin-layer coated toner was measured by installing a differential pressure instrument on the through-hole provided in the rotary stirring section of the rotary stirring apparatus. The pressure in the powder passage was able to be properly changed by adjusting an amount of the carrier gas supplied from the air tube of the two-fluid nozzle to the inside of the powder passage and a throttle of the throttle valve in the gas exhausting section. The pressure in the powder passage was adjusted so as to be 0.03 atm higher than the pressure outside the powder passage. Lit the time, an exhaustion concentration of the liquid substance exhausted through the through-hole and the gas exhausting section was stable at approximately 2.8 vol %. Furthermore, the air flow exhausted to the outside of the powder passage was 10 L/min. Note that the pressure outside the powder passage was normal pressure.

Example 2

The pressure outside the powder passage was normal pressure and the resin-layer coated toner of Example 2 was obtained in the same manner as Example 1, except that air pressure from the rotary shaft section was adjusted such that the pressure in the powder passage was 0.04 atm higher than the pressure outside the powder passage.

Example 3

The pressure outside the powder passage was normal pressure and the resin-layer coated toner of Example 3 was obtained in the same manner as Example 1, except that air pressure from the rotary shaft section was adjusted such that the pressure in the powder passage was 0.07 atm higher than the pressure outside the powder passage.

Example 4

The pressure outside the powder passage was normal pressure and the resin-layer coated toner of Example 4 was obtained in the same manner as Example 1, except that air pressure from the rotary shaft section was adjusted such that the pressure in the powder passage was 0.12 atm higher than the pressure outside the powder passage.

Example 5

The pressure outside the powder passage was normal pressure and the resin-layer coated toner of Example 5 was obtained in the same manner as Example 1, except that air pressure from the rotary shaft section was adjusted such that the pressure in the powder passage was 0.25 atm higher than the pressure outside the powder passage.

Example 6

The pressure outside the powder passage was normal pressure and the resin-layer coated toner of Example 6 was obtained in the same manner as Example 1, except that air pressure from the rotary shaft section was adjusted such that the pressure in the powder passage was 0.30 atm higher than the pressure outside the powder passage.

Comparative Example 1

The resin-layer coated toner of Comparative Example 1 was obtained in the same manner as Example 1, except that the powder inputting section and the gas exhausting section were released such that the pressure in the powder passage was equal to the pressure outside the powder passage.

Comparative Example 2

The pressure outside the powder passage was normal pressure and the resin-layer coated toner of Comparative Example 2 was obtained in the same manner as Example 1, except that air pressure was adjusted by a pump suction of the gas exhausting section such that the pressure in the powder passage was 0.10 atm lower than the pressure outside the powder passage.

(Evaluation)

The resin-layer coated toners of Examples 1 to 6 and Comparative Examples 1 and 2 obtained as described above were evaluated with respect to a yield, a ratio of coarse-powder content, and coating uniformity as follows.

[Yield]

The yield of the resin-layer coated toner was calculated using the following formula (3) and the yield of the resin-layer coated toners of Examples 1 to 6 and Comparative Examples 1 and 2 was evaluated.

$$\text{The yield of the resin-layer coated toner (\%)} = \{\text{Weight of the collected resin-layer coated toner}/(\text{Weight of the input toner base particle} + \text{weight of sold fine resin particle})\} \times 100 \quad (3)$$

Evaluation standards were as follows.

Good: Favorable. The calculated yield of the resin-layer coated toner was 90% or more.

Not Bad: No problem with Practical use. The calculated yield of the resin-layer coated toner was 80% or more and less than 90%.

Poor: No good. The calculated yield of the resin-layer coated toner was less than 80%.

[Ratio of Coarse-Powder Content]

The resin-layer coated toners of Examples 1 to 6 and Comparative Examples 1 and 2 were measured with a grain size distribution-measuring apparatus (trade name: Multisizer 3, Beckman Coulter Inc.) to obtain the ratio of a content of a coarse powder of 12 μm or more from the volume grain size distribution of the toner.

Evaluation standards were as follows:

Good: Favorable. The coarse-powder content in the resin-layer coated toner was less than 3%.

Not Bad: No problem with practical use. The coarse-powder content in the resin-layer coated toner was 3% or more and less than 5%.

Poor: No good. The coarse-powder content in the resin-layer coated toner was 5% or more.

[Coating Uniformity]

To 100 parts of the resin-layer coated toners of Examples 1 to 6 and Comparative Examples 1 and 2, 1.0 part of silica particle hydrophobically treated with a silane coupling agent and having an average primary particle size of 20 nm was mixed to be externally added, and the resin-layer coated toner was used to evaluate the coating uniformity depending on presence/absence of an aggregate after high-temperature storage. After 20 g of the resin-layer coated toner with the silica externally added was sealed in a plastic container and left for forty-eight hours at 50° C., the resin-layer coated toner was taken out to pass through a 230-mesh sieve. The weight of the resin-layer coated toner remaining on the sieve was measured and a remaining amount which is a ratio of the weight to the total weight of the resin-layer coated toner was obtained to evaluate with the following standards. The lower value shows that the toner is not blocked and preservability is excellent.

Evaluation standards were as follows:

Good: Trace aggregations. The remaining amount was less than 1%.

Not Bad: Few aggregations. The remaining amount was 1% or more and less than 3%.

Poor: Many aggregations. The remaining amount was 3% or more.

[Comprehensive Evaluation]

A comprehensive evaluation of the method for manufacturing a toner of the invention was conducted based on the evaluations of the yield, the ratio of the coarse-powder content and the coating uniformity above.

Comprehensive evaluation standards were as follows:

Good: Favorable. All evaluation results were "Good".

Not Bad: Fair. There was no "Poor" in all evaluation results and one or more "Not Bad" was included.

Poor: No good. "Poor" was included in at least any one of the evaluation results of the yield, the ratio of the coarse-powder content and the coating uniformity.

Table 1 shows the evaluation results and the comprehensive evaluation results of the resin-layer coated toners obtained in Examples 1 to 6 and Comparative Examples 1 and 2.

TABLE 1

| | Difference between pressure $P_1$ in powder passage and pressure $P_0$ outside powder passage (atm) | Exhausted air (L/min) | Yield | | Ratio of coarse-powder content (%) | | Coating uniformity | | |
|---|---|---|---|---|---|---|---|---|---|
| | | | Yield (%) | Evaluation | Content (%) | Evaluation | Remaining amount (%) | Evaluation | Comprehensive evaluation |
| Example 1 | 0.03 | 10 | 98 | Good | 0.8 | Good | 0 | Good | Good |
| Example 2 | 0.04 | 10 | 98 | Good | 1.2 | Good | 0 | Good | Good |
| Example 3 | 0.07 | 10 | 98 | Good | 1.1 | Good | 0 | Good | Good |
| Example 4 | 0.12 | 10 | 98 | Good | 1.3 | Good | 0 | Good | Good |
| Example 5 | 0.25 | 10 | 90 | Good | 2.5 | Good | 0 | Good | Good |
| Example 6 | 0.3 | 10 | 82 | Not Bad | 3.7 | Not Bad | 0.8 | Good | Not Bad |
| Comparative Example 1 | 0 | suction pump | 75 | Poor | 5.8 | Poor | 2.1 | Not Bad | Poor |
| Comparative Example 2 | −0.1 | suction pump | 70 | Poor | 2.7 | Good | 5.8 | Poor | Poor |

As shown in Table 1, in Examples 1 to 6 with the pressure in the powder passage higher than the pressure outside the powder passage, it was found that the resin-layer coated toner with low ratio of the coarse-powder content and excellent in the coating uniformity was able to be obtained with high yield. However, since the difference between the pressure in the powder passage and the pressure outside the powder passage was relatively large in Example 6, the ratio of the coarse-powder content was slightly increased and both the coating uniformity and the yield were slightly lowered.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for manufacturing a resin-layer coated toner using a rotary stirring apparatus that comprises a circulating section including a rotary stirring section having a rotary disc around which rotary blades are installed and a rotary shaft, and a powder passage having a rotary stirring chamber and a circulation tube, the circulating section repeatedly circulating toner base particles and fine resin particles by the rotary stirring section inside the powder passage to return to the rotary stirring chamber; a temperature regulation section provided at least on a part of the powder passage for adjusting a temperature in the powder passage and the rotary stirring section to a predetermined temperature; a spraying section that includes a two-fluid nozzle for spraying to toner base particles and fine resin particles in a fluidized state a liquid substance to plasticize such particles by carrier gas; and an exhausting section for exhausting carrier gas including the gasified substance to the outside of the powder passage, the method comprising:

circulating the carrier gas in the powder passage; and continuously exhausting the carrier gas including the gasified substance to the outside of the power passage through the exhausting section, pressure $P_1$ in the powder passage and pressure $P_0$ outside the powder passage satisfying the following formula (1):

$$0\ \text{atm} < (\text{Pressure } P_1 \text{ in the powder passage} - \text{Pressure } P_0 \text{ outside the powder passage}) \leqq 0.3\ \text{atm} \quad (1).$$

2. The method of claim 1, wherein the pressure $P_0$ outside the powder passage is normal pressure, and the pressure $P_1$ in the powder passage and the pressure $P_0$ outside the powder passage satisfy the following formula (2):

$$0.03\ \text{atm} \leqq (\text{Pressure } P_1 \text{ in the powder passage} - \text{Pressure } P_0 \text{ outside the powder passage}) \leqq 0.25\ \text{atm} \quad (2).$$

3. The method of claim 1, wherein the liquid substance includes at least an alcohol.

* * * * *